US006825865B2

(12) United States Patent
Fujimoto et al.

(10) Patent No.: US 6,825,865 B2
(45) Date of Patent: Nov. 30, 2004

(54) PRINTHEAD WITH LIQUID CRYSTAL SHUTTER

(75) Inventors: Hisayoshi Fujimoto, Kyoto (JP); Hiroaki Onishi, Kyoto (JP); Minori Koshio, Kyoto (JP); Toshihiko Takakura, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 0 days.

(21) Appl. No.: 10/346,735

(22) Filed: Jan. 16, 2003

(65) Prior Publication Data

US 2004/0080559 A1 Apr. 29, 2004

(30) Foreign Application Priority Data

| | | |
|---|---|---|
| Jan. 18, 2002 | (JP) | 2002-010002 |
| Jan. 24, 2002 | (JP) | 2002-015226 |
| Apr. 5, 2002 | (JP) | 2002-104563 |
| Aug. 19, 2002 | (JP) | 2002-238012 |

(51) Int. Cl.[7] ..... B41J 4/435; B41J 2/45
(52) U.S. Cl. ..... 347/232; 347/238
(58) Field of Search ..... 347/232, 238, 347/241, 244, 256, 258, 239, 255; 345/102; 349/3, 65, 118; 385/116; 252/299.01

(56) References Cited

U.S. PATENT DOCUMENTS

| | | | | | |
|---|---|---|---|---|---|
| 4,859,034 | A | * | 8/1989 | Shiraishi et al. | 349/3 |
| 4,928,122 | A | * | 5/1990 | Doi et al. | 347/241 |
| 5,727,107 | A | * | 3/1998 | Umemoto et al. | 385/116 |
| 5,825,445 | A | * | 10/1998 | Okamoto et al. | 349/118 |
| 5,883,684 | A | * | 3/1999 | Millikan et al. | 349/65 |
| 6,111,560 | A | * | 8/2000 | May | 345/102 |
| 6,414,705 | B1 | * | 7/2002 | Yamada et al. | 347/232 |
| 6,599,442 | B2 | * | 7/2003 | Green | 252/299.01 |

FOREIGN PATENT DOCUMENTS

| | | |
|---|---|---|
| JP | 11-240231 | 9/1999 |

* cited by examiner

*Primary Examiner*—Hai Pham
(74) *Attorney, Agent, or Firm*—Merchant & Gould P.C.

(57) ABSTRACT

The present invention relates to a print head (3) including an illuminator (5) for emitting light in a line extending in a primary scanning direction, a liquid crystal shutter (6) for selecting whether or not light traveling from the illuminator (5) is allowed to pass, and a light emitting portion (323) for emitting light traveling from the liquid crystal shutter (6) toward a photosensitive recording medium (22). The liquid crystal shutter (6) includes a plurality of individual shutter portions aligned in the primary scanning direction, for example. Preferably, each of the shutter portions is capable of individually selecting whether or not the light traveling from the illuminator (5) is allowed to pass.

42 Claims, 27 Drawing Sheets

PRINTHEAD WITH LIQUID CRYSTAL SHUTTER

BACKGROUND OF THE INVENTION

1. Field of the Invention

The present invention relates to a printer used for forming images on a photosensitive recording medium by a photosensitive system.

2. Description of the Related Art

An image captured by a digital camera, for example, can be formed on an ordinary paper based on the digital data by an ink jet system or a thermal transfer system. It is also considered to record such an image on a photosensitive film based on the digital data by a photosensitive system. In the photosensitive system, an image is formed by exposing a photosensitive film to light followed by developing the film. Therefore, an image forming apparatus utilizing this system can be made compact relatively easily as compared with one utilizing the ink jet system or the thermal transfer system. For this reason, a digital camera has been commercially introduced which incorporates a print head of a photosensitive type for printing an image immediately after capturing the image. For easier carriage of the digital camera, it is necessary to reduce the size of the print head as well as other parts of the camera.

In forming an image on a photosensitive film by the photosensitive system, for example, the photosensitive film is irradiated with light in the form of a line extending in the primary scanning direction and the irradiation region is shifted in the secondary scanning direction for scanning the entirety of the photosensitive film. As the print head for emitting light in the form of a line, use may be made of one including a plurality of light emitting elements (point light sources) aligned in a row extending in the primary scanning direction. As the light emitting elements, light emitting diodes are typically used. However, organic EL light emitting elements may alternatively be used. An organic EL element means an element which emits light by electroluminescence when electric field is applied to a light emitting layer containing an organic material.

However, light emitting elements deteriorate with a lapse of time, reducing the amount of light emitted. Particularly, EL light emitting elements are likely to deteriorate due to the formation of impurities or entering of water in the light emitting layer. Further, the plurality of light emitting elements do not deteriorate to a same degree with a lapse of time and differ from each other in speed of deterioration. Therefore, when one light emitting element deteriorates to a considerably large degree (thereby emitting little amount of light) as compared with others, it is impossible to irradiate the photosensitive film properly with linear light. In such a case, when the print head is moved in the secondary scanning direction to irradiate the entire photosensitive film with light, a portion of the photosensitive film extending in the secondary scanning direction is left insufficiently irradiated with light. This portion appears as a line in the formed image. This also means that a print head has a short lifetime when a light emitting element such as an organic EL light emitting element which is likely to deteriorate is utilized.

Although, an LED is unlikely to deteriorate as compared with an organic EL light emitting element, its power consumption is disadvantageously higher than that of the organic EL element. Therefore, when a plurality of LEDs are used as a light source of a print head, its power consumption becomes high. Since the printer of a digital camera as a portable device typically uses a low-capacity dry cell or rechargeable battery as the light source, the power consumption need be decreased.

SUMMARY OF THE INVENTION

The present invention aims to provide a print head for irradiating a photosensitive recording medium with light, which is firstly capable of preventing deterioration of a formed image due to the degradation of the light source for forming a proper image, which secondly has a long lifetime, and which thirdly has a small size and low power consumption.

According to the present invention, there is provided a print head comprising an illuminator for emitting light in a line extending in a primary scanning direction, a liquid crystal shutter for selecting whether or not light traveling from the illuminator is allowed to pass and, and a light emitting portion for emitting light traveling from the liquid crystal shutter toward a photosensitive recording medium.

With such a structure, after light emitted from the illuminator becomes incident on the liquid crystal shutter, the light passing through the liquid crystal shutter is emitted from the light emitting portion. Thus, the liquid crystal shutter can define the state of light (amount, wavelength and the like) to be emitted from the light emitting portion. Therefore, even when the light source device includes a portion emitting a smaller amount of light, for example, and hence variation exists in the amount of light, the liquid crystal shutter can eliminate such variation.

For example, the liquid crystal shutter may include a plurality of individual shutter portions aligned in the primary scanning direction. In this case, each of the shutter portions is capable of individually selecting whether or not the light traveling from the illuminator is allowed to pass.

For example, the illuminator may emit light (e.g. white light) which includes red light, green light and blue light. Specifically, the illuminator may be provided with a light emitting portion in the form of a strip extending in the primary scanning direction or a plurality of point light emitting portions aligned in a row extending in the primary scanning direction. For performing color printing using such an illuminator, the plurality of shutter portions may include a plurality of first shutter portions aligned in a row extending in the primary scanning direction for selectively passing red light, a plurality of second shutter portions aligned in a row extending in the primary scanning direction for selectively passing green light, and a plurality of third shutter portions aligned in a row extending in the primary scanning direction for selectively passing blue light.

The liquid crystal shutter may include a plurality of first electrodes arranged adjacent to each other, a plurality of second electrodes arranged adjacent to each other and extending transversely to the first electrodes, and a liquid crystal layer provided between the first electrodes and the second electrodes. In this case, the transverse portions of the first and the second electrodes correspond to the first through the third shutter portions.

With such a structure, for irradiating the photosensitive recording medium with red light for example, a shutter portion through which red right is to pass is selected from the first shutter portions depending on the image to be formed, and light is allowed to pass through the selected first shutter portion. For the selected first shutter portion, a voltage is applied to the liquid crystal between the first electrode and the second electrode constituting the first shutter portion. At that time, when a non-selected first shutter portion through which red light should not pass exists adjacent to the selected first shutter portion, a potential difference is generated between the adjacent first electrodes or between the adjacent second electrodes constituting these shutter portions. Such a potential difference is more likely to be generated as the distance between the electrodes (between adjacent shutter portions) decreases. When the potential difference is generated between the adjacent electrodes, the alignment of liquid crystal nearby is disturbed. As a result, the light component of green light or blue light, for example, may unintentionally pass through the liquid crystal shutter.

For dissolving such a problem, it is preferable that the first shutter portions, the second shutter portions and the third shutter portions are respectively arranged in a plurality of rows, and that the shutter portions in each row are disposed in staggered relationship with the shutter portions in an adjacent row. With such an arrangement, a relatively large distance can be kept between adjacent shutter portions. Therefore, the disturbance of liquid crystal around the non-selected shutter portion can be avoided, which prevents unintended light from passing through the liquid crystal shutter for emission from the print head.

For arranging the first through the third shutter portions in staggered relationship in two rows, the liquid crystal shutter may be structured as follows. That is, the plurality of first electrodes includes a pair of electrodes for red light, a pair of electrodes for green light and a pair of electrodes for blue light, and each of the second electrodes includes a plurality of main overlapping portions which overlap one of the paired electrodes for red light, one of the paired electrodes for green light or one of the paired electrodes for blue light, and a connecting portion connecting adjacent ones of the main overlapping portions. Preferably, the connecting portion is smaller in width than the main overlapping portions. In this case, the main overlapping portions correspond to the first through the third shutter portions.

Preferably, the liquid crystal shutter is adapted for driving in OCB mode. In this case, the liquid crystal shutter includes a first transparent substrate, a second transparent substrate arranged in facing relationship to the first transparent substrate, and liquid crystal retained between the first and the second transparent substrates so as to keep splay alignment when no voltage is applied. In this case, the liquid crystal shutter includes a phase compensation film laminated on at least one of the first and the second transparent substrates. When the OCB mode is utilized, the state of the liquid crystal readily changes in response to the change of the voltage application, which realizes high-speed printing.

The print head of the present invention may further comprise control means for driving the liquid crystal shutter. Preferably, the control means operates for applying a voltage to the liquid crystal which is higher than a minimum transition voltage required for causing transition of the liquid crystal from splay alignment to bend alignment. For example, the liquid crystal shutter includes at least one first electrode formed on the first transparent substrate and at least one second electrode formed on the second transparent substrate. In this case, at least one first electrode and at least one second electrode are utilized for applying voltage to the liquid crystal. In causing transition of the liquid crystal from splay alignment to bend alignment, the control means applies an AC voltage to the first electrode while applying an AC voltage to the second electrode to provide an AC waveform having a same cycle as and 180-degrees phase-shifted from that of the AC voltage of the first electrode, a voltage applied across the liquid crystal being higher than the minimum transition voltage.

In the OCB mode, after the transition of the liquid crystal from the splay alignment to the bend alignment is performed, the actual driving is performed in the bend alignment state. When a high voltage is applied during the transition, the time required for the transition is shortened, which leads to the shortening of the time required for printing.

The liquid crystal shutter may comprise TN liquid crystal retained between the first and the second transparent substrates. In such a case, it is preferable to add cyanide as a chiral dopant. In such a case, the viscosity of the liquid crystal reduces so that the state of the liquid crystal readily changes in response to the change of the voltage application, which realizes high-speed printing.

Preferably, cyanide may be added in an amount of 0.1–4.0 parts by weight relative to 100 parts by weight of liquid crystal, and the viscosity of the liquid crystal may be 10–20 mPa·s.

The liquid crystal shutter may comprise a pair of transparent substrates and ferroelectric liquid crystal or antiferroelectric liquid crystal retained therebetween. Ferroelectric liquid crystal or antiferroelectric liquid crystal is highly responsive to the change of the state of voltage application. Therefore, when such liquid crystal is used for the liquid crystal shutter, the ON/OFF operation of individual shutter portions can be performed with high responsiveness, which realizes high-speed printing.

For the illuminator, use may be made of one that can individually emit red light, green light and blue light. For example, the illuminator includes a red light source for emitting red light in a line, a green light source for emitting green light in a line, and a blue light source for emitting blue light in a line. In this case, each of the red light source, green light source and blue light source may be a linear light source in the form of a strip or may comprise a plurality of point light sources aligned in a row. For individually emitting red light, green light and blue light, these colors of light may be successively emitted. Alternatively, these colors of light may be emitted at the same time to emit white light, and red, green or blue light may be taken out by the use of a liquid crystal shutter.

The illuminator may be provided with an organic light source including a light emitting layer containing an organic material. The organic material emits light by electroluminescence when electric field is applied.

As described above, a light emitting element utilizing organic EL is more likely to deteriorate as compared with an LED light source. Therefore, the present invention, which is capable of reducing the influence of deterioration of the illuminator (light emitting element), is useful for a print head with a light source utilizing organic EL. Since a light emitting element utilizing organic EL has low power consumption, the use of such a light emitting element can decrease the power consumption of the print head.

Preferably, the organic light source may be covered with a sealing portion formed of an inorganic insulating material.

With such an arrangement, the organic light source is protected from an external force. Since an inorganic compound is generally less likely to absorb water as compared with an organic compound, the sealing portion can prevent water from the surroundings from entering the illuminator. When water is prevented from entering the illuminator, the deterioration of the light source can be suppressed even when the light source includes a light emitting layer containing an organic material. Therefore, it is possible to prolong the lifetime of the light source and hence the lifetime of the print head.

For example, the illuminator may include a light source device including one or a plurality of point light sources, and a light guide for guiding the light emitted from the point light sources for emission in a line extending in the primary scanning direction.

Since this structure utilizes a light guide, the photosensitive recording medium can be irradiated with linear light without aligning light emitting elements (point light sources) in a row. As a result, irradiation of the photosensitive film is possible even with a small number of light sources. Therefore, the power consumption of the print head can be decreased even with the use of an LED as the light source. When the LED is used as the light source, deterioration of the image quality due to the deterioration of the light source can be prevented, which leads to a prolonged lifetime of the print head.

For example, the light guide has a bar-like configuration extending in the primary scanning direction. The light guide may include a light incident surface for guiding light therein, and a light reflecting surface, and a light emitting surface spaced thicknesswise from the light reflecting surface. Preferably, the light incident surface is provided at an end portion of the light guide. The light reflecting surface includes a plurality of inclined surfaces inclined toward the light incident surface for making light traveling from the light incident surface emit from the light emitting surface.

For example, the plurality of inclined surfaces are provided by forming a plurality of recesses at an obverse surface of the light guide. The plurality of inclined surfaces may be equal or substantially equal to each other in angle of inclination, for example. Preferably, the plurality of recesses have progressively increasing depths away from the light incident surface. With this structure, a farther portion from the light incident surface receives a larger amount of light, which eliminates variation of the amount of light in the primary scanning direction.

The light guide may include a plurality of additional inclined surfaces for guiding light reflected at an end surface located opposite to said end portion toward the light emitting surface. For the light reflected by the end surface opposite to the end on the light incident side, the light is more likely to be reflected by the additional inclined surfaces at a portion farther from the light incident surface. Therefore, a large amount of light can be obtained at a portion far from the light incident surface, so that variation of the amount of light in the primary scanning direction can be eliminated.

Preferably, the light guide is covered with a light shield for absorbing light emitted from the light guide. The light shield prevents light traveling from the illuminator from being emitted toward portions other than the liquid crystal shutter. Preferably, the light shield is formed with an opening extending in the primary scanning direction for emitting light therethrough, and the light shield includes a first light shielding portion covering the light emitting surface of the light guide and a second light shielding portion covering portions of the light guide other than the light emitting surface. In this way, it is preferable to cover the light guide as much as possible by the light shield except the portion contributing to the light emission toward the liquid crystal shutter.

Preferably, the light guide is covered with a reflector for returning light exiting the light guide into the light guide. With such a structure, light emitted from the light source is efficiently utilized. The reflector may be covered with a light shield for absorbing light passing through the reflector.

The plurality of point light sources include a red point light source for emitting red light, a green point light source for emitting green light and a blue point light source for emitting blue light, for example. In this case, the light source device includes a substrate on which the red point light source, the green point light source and the blue point light source are mounted, and a plurality of wirings formed on the substrate.

Preferably, the red point light source, the green point light source and the blue point light source are aligned in a row extending in the secondary scanning direction. In this case, the substrate and the light incident surface face each other while standing upright with respect to the light emitting surface. With such a structure, the row of three kinds of point light sources extends perpendicularly to the thickness direction of the light guide. Therefore, the use of three kinds of light sources does not increase the dimension of the substrate in the perpendicular direction (width of the substrate), so that the thickness of the light source device including the light guide can be decreased.

For example, each of the red point light source, the green point light source and the blue point light source includes a first electrode and a second electrode. The plurality of wirings are formed on a surface of the substrate on which the point light sources are mounted, and the wirings include a first wiring electrically connected to the first electrode via a conductor wire and a second wiring electrically connected to the second electrode. Preferably, in this case, the conductor wire extends obliquely to a direction perpendicular to the row of the light sources. When the conductor wire is arranged to extend obliquely to a direction perpendicular to the row of the light sources, the width of the substrate and hence the thickness of the light source device can be prevented from increasing.

For example, each of the red point light source, the green point light source and the blue point light source is capable of being driven individually. That is, in the print head of the present invention, the red point light source, the green point light source and the blue point light source may be successively turned on for irradiating the photosensitive recording medium individually with red linear light, green linear light and blue linear light.

The light source device (one point light source) may emit light including red light, green light and blue light. In that case, it is preferable that the liquid crystal shutter includes a plurality of individual shutter portions. For example, the plurality of shutter portions include a plurality of first shutter portions for selectively passing red light, a plurality of second shutter portions for selectively passing green light, and a plurality of third shutter portions for selectively passing blue light. Preferably, the one or plurality of point light sources may comprise LED bare chips. In that case, the area of the substrate required for mounting the light source is smaller than that required for mounting a resin-packaged light source, so that the thickness of the light source device is prevented from increasing.

Preferably, the light entrance side of the liquid crystal shutter is covered with a light shielding layer formed with a through-hole for limiting light entering the liquid crystal shutter.

With such a structure, the light with a large incident angle is unlikely to pass through the through-hole to reach the liquid crystal shutter, whereas the light with a small incident angle is likely to pass through the through-hole to reach the liquid crystal shutter. Therefore, the light reaching the liquid crystal shutter has a high directivity, which makes it possible to properly irradiate the photosensitive recording medium with light.

A light diffusing portion may be provided between the illuminator and the liquid crystal shutter.

In the light diffusing portion, light is diffused while the light incident on the light emitting surface at an angle smaller than the critical angle for total reflection is emitted. Therefore, light emitted from the light diffusing layer has a low emission angle and a high directivity. By diffusing light in the light diffusing portion before entering the liquid crystal shutter, it is possible to eliminate the variation in the amount of light, which may initially exist due to the existence of a portion emitting a smaller amount of light in the light source, for example.

Preferably, the light emitting portion includes a projection for coming into engagement with the photosensitive recording medium and a recess for emitting light in the form of a line. With such a structure, when the print head is moved relative to the photosensitive recording medium in close contact with the photosensitive recording medium, it is possible to remove the deflection of the recording medium for preventing defocusing. Further, the sliding resistance between the photosensitive recording medium and the print head can be decreased. As a result, it is possible to smoothly move the print head relative to the photosensitive recording medium, while preventing both the photosensitive recording medium and the print head from being damaged for maintaining the quality of printing.

Preferably, the print head of the present invention further comprises a frame having a predetermined thickness and elongated in the primary scanning direction for supporting the illuminator and the liquid crystal shutter. Preferably, the illuminator and the liquid crystal shutter are elongate in the primary scanning direction, and the illuminator is stacked on the liquid crystal shutter to provide a stack unit, and the stack unit is supported in close contact with the frame at a position deviated thicknesswise from a center of the frame.

Since the illuminator and the liquid crystal shutter are generally elongate in the primary scanning direction, each of these members by itself has a low flexural rigidity against a load in the thickness direction. However, when the illuminator and the liquid crystal shutter are combined to provide a stack unit and the stack unit is held by the frame, the flexural rigidity of the print head is enhanced. Therefore, the print head can be prevented from warping or flexing. Further, when the stack unit is supported on the frame at a position deviated from the center of the frame in the thickness direction, the stack unit is reinforced by the frame, which further enhances the flexural rigidity of the entire print head.

When the flexural rigidity is increased by the use of the frame, the print head can be made thin while avoiding the warping or flexing, which contributes to the size reduction of an image forming apparatus or a digital camera incorporating the print head. Further, when the print head is prevented from warping or flexing, proper light irradiation of the photosensitive recording medium can be performed. This holds true even when the pixel pitch is reduced for realizing high density recording. According to the present invention, therefore, an image with high resolution can be formed.

Preferably, the print head according to the present invention further comprises a lens array including a plurality of lenses aligned in a direction perpendicular to their lens axes. Preferably, in this case, the lens array is held between the stack unit and the frame with the lenses aligned in the primary scanning direction while the lens axes extending in the secondary scanning direction. With this structure, the direction of light traveling through each lens of the lens array extends perpendicularly to the thickness direction of the frame (i.e. extends in the secondary scanning direction). Therefore, the use of the lenses does not greatly increase the thickness of the print head. Further, by disposing the lens array between the stack unit and the frame, the rigidity of the entire print head can be increased.

Preferably, in the print head provided with a lens array, light is emitted from the stack unit for traveling thicknesswise of the frame and the light enters the lens array after its traveling direction is changed by 90 degrees or substantially 90 degrees. Light emitted from the lens array changes its traveling direction by 90 degrees or substantially 90 degrees. For example, the traveling direction of the light emitted from the lens array may be changed by a prism provided with a light emitting portion by 90 degrees or substantially 90 degrees.

Preferably, the prism may include a light incident surface for entrance of light traveling from the lens array, and the light incident surface may be formed with a recess extending in the primary scanning direction.

The lens array may be held by the frame with the plural lenses aligned in the primary scanning direction while the lens axes extending thicknesswise of the frame. In this case, the light emitting portion is provided at a bar-like member elongated in the primary scanning direction and held by the frame. The bar-like member may include a projection for coming into engagement with the photosensitive recording medium and a recess for emitting light in a line. Preferably, in this case, the bar-like member may be held by the frame with the projection projecting from the frame.

DETAILED DESCRIPTION OF THE PREFERRED EMBODIMENTS

Preferred embodiments of the present invention will be described below in detail with reference to the accompanying drawings.

Figure 1:
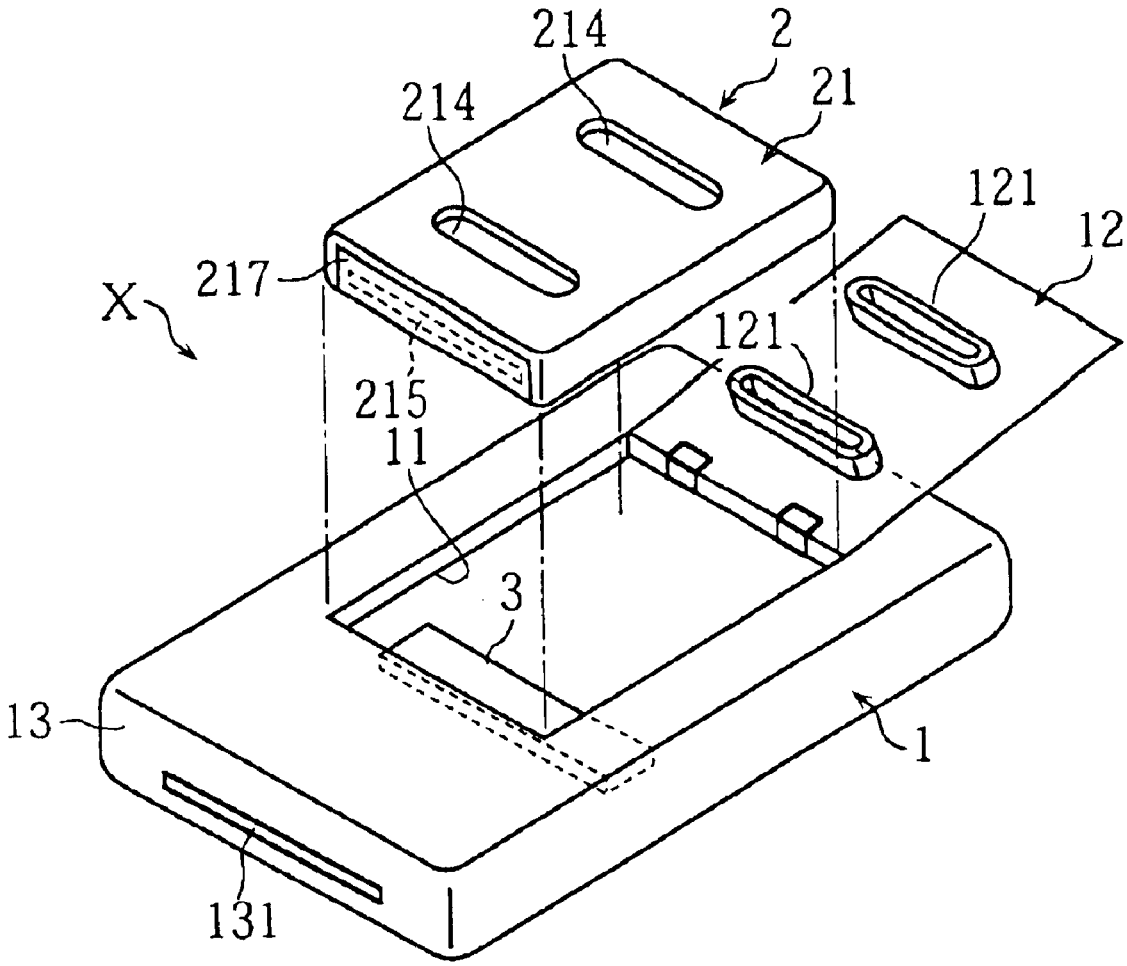
FIG. 1 is an exploded perspective view illustrating an image forming apparatus according to a first embodiment of the present invention.
Figure 2:
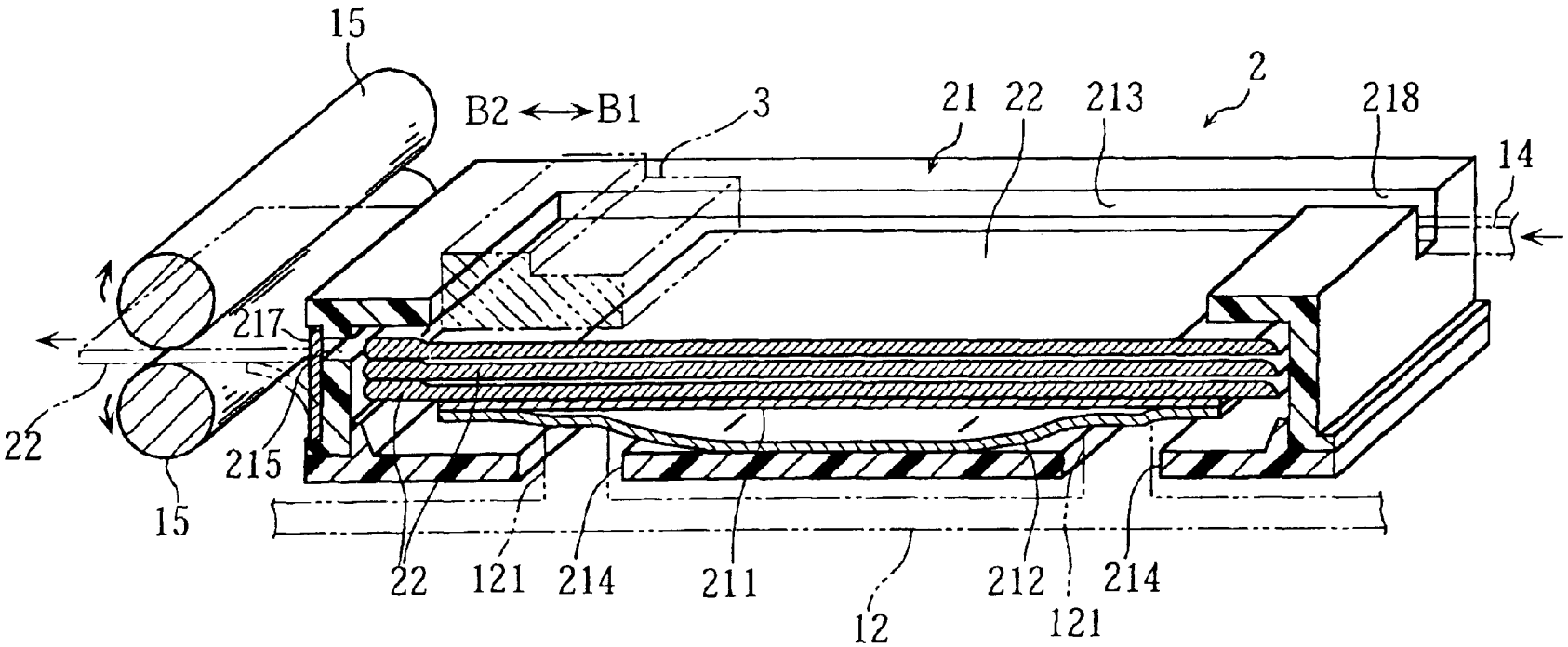
FIG. 2 is a sectional view illustrating a principal portion of the image forming apparatus.

Firstly, a first embodiment of the present invention will be described with reference to FIGS. 1-11. As shown in FIGS. 1 and 2, an image forming apparatus X includes a housing 1, a film pack 2 and a print head 3.

As shown in FIG. 1, the housing 1 includes an opening 11 which is openable and closable by a lid 12. The lid 12 is provided with a pair of projections 121. The housing 1 has a side surface 13 which is formed with a discharge port 131 for discharging a photosensitive film 22 (See FIGS. 2 and 3) after the exposure and development process.

As shown in FIG. 2, the film pack 2 comprises a case 21 and a plurality of photosensitive films 22 housed in the case. The photosensitive films 22 are disposed on a support base 211. The support base 211 is biased by a leaf spring 212.

As shown in FIGS. 1 and 2, the case 21 is formed with first thorough third openings 213, 214 and 215. The print head 3 is arranged in the first opening 213. The print head 3 may be movable in the first opening 213 in the direction indicated by arrows B1 and B2 or may be fixed to the housing 1. The second openings 214 are provided at locations corresponding to the projections 121 of the lid 12. Thus, as shown in FIG. 2, when the opening 11 is closed with the lid 12, the projections 121 are inserted in the case 21 through the second openings 214. As a result, a pressing force toward the first opening 213 is exerted on the support base 211. The third opening 215 is provided at a side surface of the case 21. The photosensitive films 22 are discharged outside the case 21 through the third opening 215. The third opening 215 is covered with a curtain 217 for preventing dust from entering the case 21 through the third opening 215.

Figure 3:
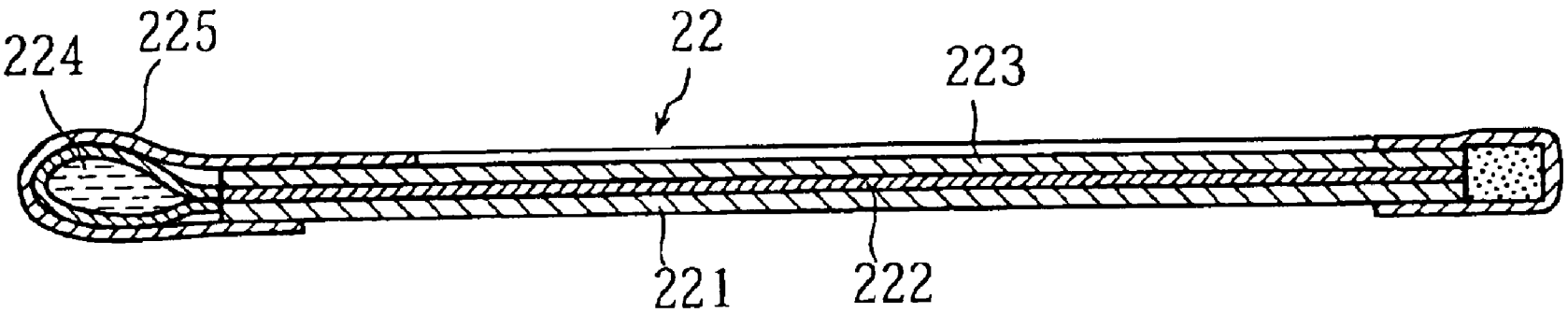
FIG. 3 is a sectional view of a photosensitive film.

As shown in FIG. 3, each of the photosensitive films 22 comprises a base member 221 on which a photosensitive layer 222 and a transparent cover 223 are laminated. The base member 221, the photosensitive layer 222 and the transparent cover 223 have an edge portion covered with an adhesive sheet 225 surrounding a developer retaining pack 224.

As is clear from FIG. 1, the film pack 2 can be put in and taken out of the housing 1 through the opening 11. When all of the photosensitive films 22 accommodated in the film pack 2 are used, the used case 21 is taken out for mounting a new film pack 2.

As shown in FIG. 2, the housing 1 further accommodates a push bar 14 and platen rollers 15. The case 21 is formed with a cutout 218 for allowing movement of the push bar 14 in the direction of arrows B1, B2 in FIG. 2. With this arrangement, the push bar 14 can push the photosensitive films 22 out of the film pack 2. The platen rollers 15 is provided for transferring the photosensitive film 22 while pulling the film out of the film pack 2, thereby discharging the film 22 from the housing 1 through the discharge port 131. Further, when the photosensitive film 22 passes between the platen rollers 15, the platen rollers exert a pressing force on the developer retaining pack 224 (See FIG. 3) of the photosensitive film 22, thereby pushing the developer out of the developer retaining pack 224 and spreading the developer onto the entire surface of the photosensitive layer 222.

Figure 4:
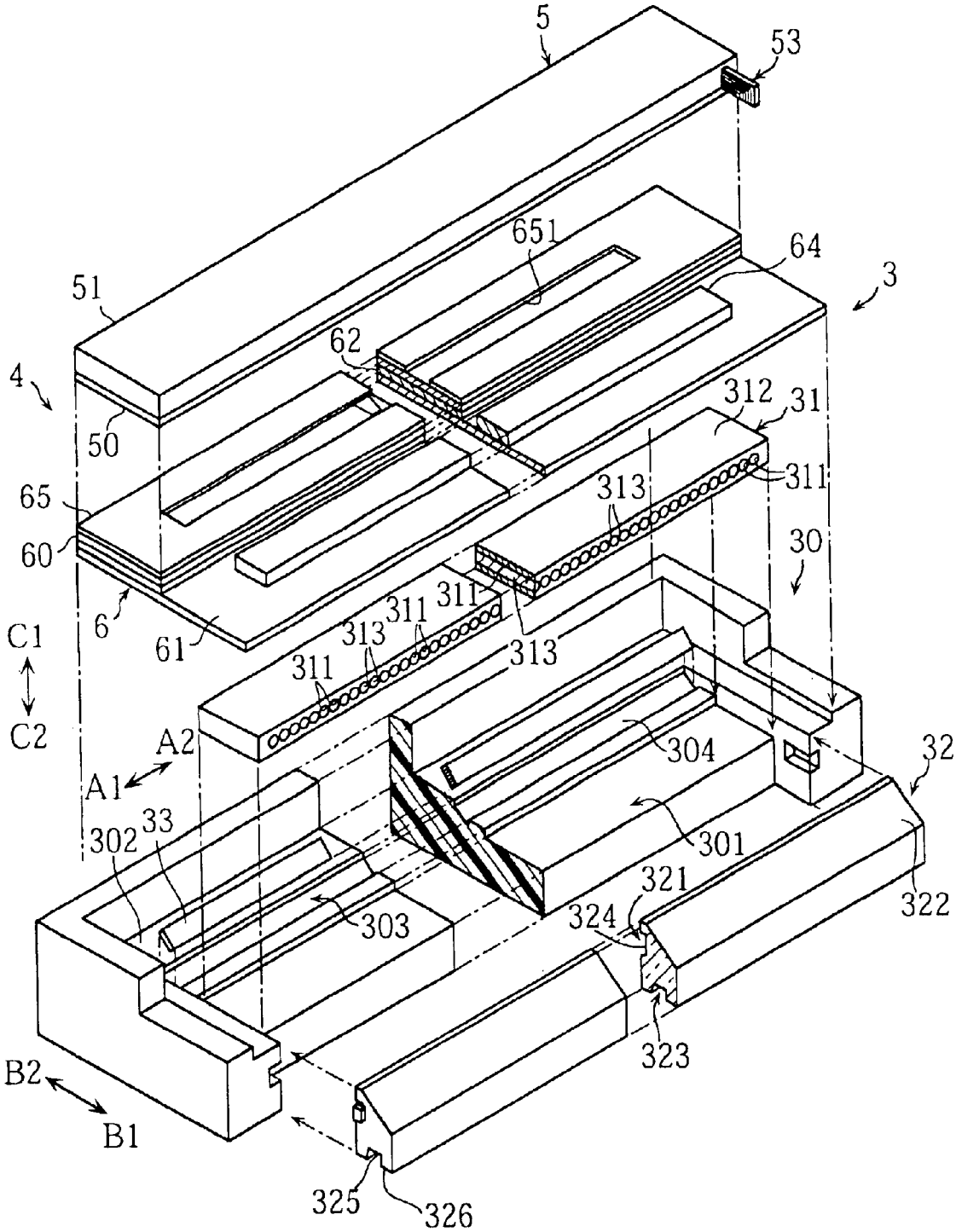
FIG. 4 is an exploded perspective view of a print head.
Figure 5:
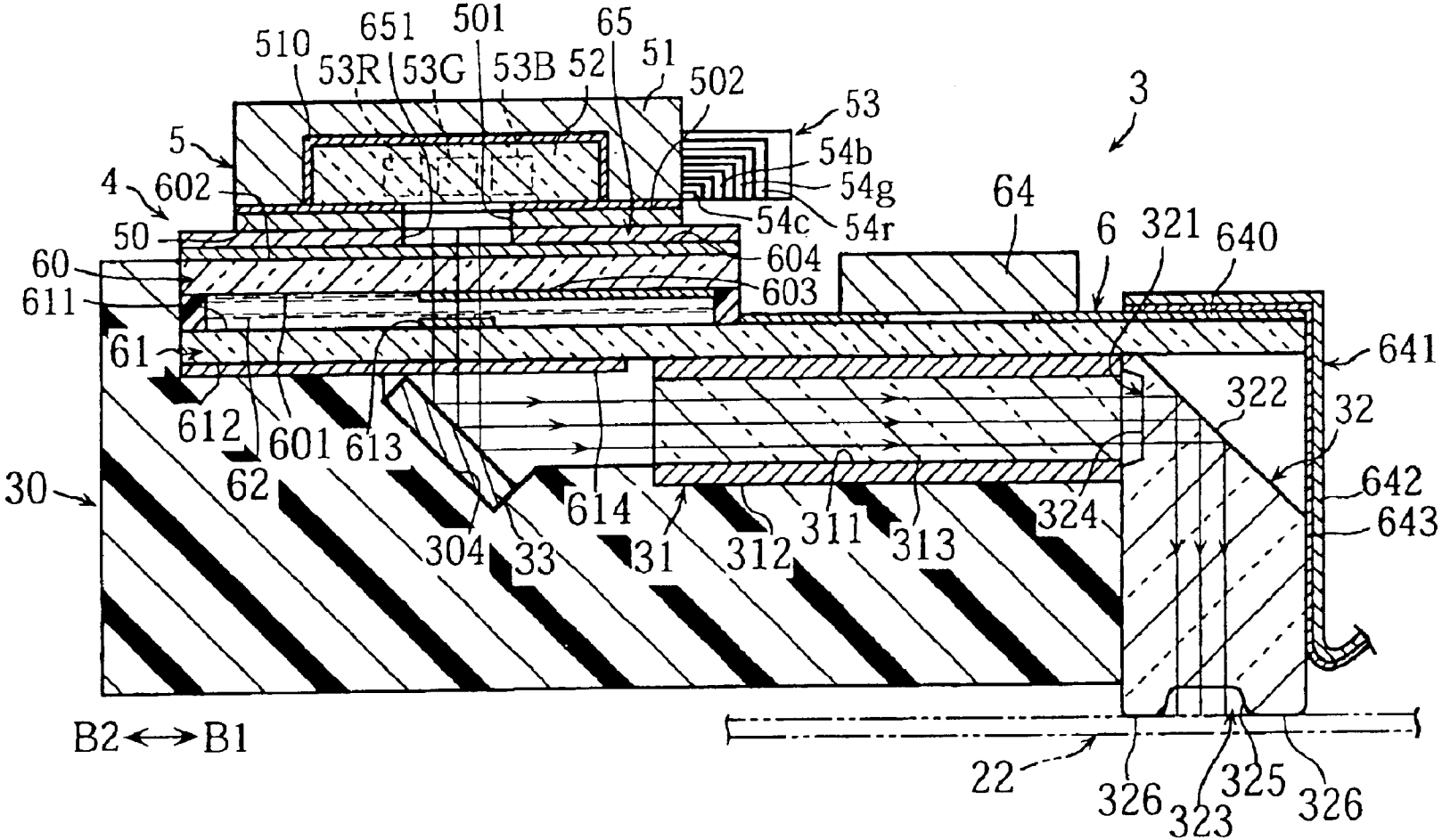
FIG. 5 is a sectional view of the print head.

As shown in FIGS. 4 and 5, the print head 3 includes a frame 30 for supporting a rod lens array 31, a prism 32, and a stack unit 4 comprising an illuminator 5 and a liquid crystal shutter 6.

The frame 30 includes a U-shaped mount portion 301, and a first and a second holding portions 302 and 303 extending in the direction (primary scanning direction) indicated by arrows A1, A2 in FIG. 4. The stack unit 4 is mounted on the mount portion 301. Therefore, the stack unit 4 is supported on the frame 30 at a position deviated from the center of the frame 30 in the thickness direction thereof.

Since the illuminator 5 and the liquid crystal shutter 6 are elongate in the primary scanning direction as shown in FIG. 4, each of these members by itself has a low flexural rigidity against a load in the thickness direction. However, as the stack unit 4, a flexural rigidity higher than that of the illuminator 5 or the liquid crystal shutter 6 alone can be provided. Further, mounting of the stack unit 4 on the frame 30 increases the flexural rigidity of the entire print head 3. Particularly, when the stack unit 4 is supported on the frame 30 at a position deviated from the center of the frame in the thickness direction, the stack unit 4 is reinforced by the frame 30, which further enhances the flexural rigidity of the entire print head 3. Therefore, the print head 3 can be prevented from warping or flexing. When the flexural rigidity of the print head 3 is increased, the print head 3 can be made thin, which contributes to the size reduction of the image forming apparatus X incorporating the print head 3.

The first holding portion 302 has an inclined surface 304 inclined 45 degrees or substantially 45 degrees for supporting a reflector 33 in close contact therewith. Preferably, the reflector 33 has an obverse surface comprising a mirror surface, which may be formed of e.g. aluminum, for normal reflection of light at the surface.

The rod lens array 31 is supported on the second holding portion 303 as sandwiched between the frame 30 and the stack unit 4. The rod lens array 31 comprises a holder 312 formed with a plurality of through-holes 311 and rod lenses 313 held in the through-holes 311. Each of the rod lenses 313 has an axis extending in the direction (secondary scanning direction) indicated by arrows B1, B2 in FIG. 4. The plural rod lenses 313 are aligned in the primary scanning direction A1, A2. In this embodiment, the rod lenses 313 form an actual size erect image.

The frame 30 has a side portion which is open toward the B1 side in the secondary scanning direction and at which the prism 32 is supported. The prism 32 includes a light incident surface 321, a light reflecting surface 322 and a light emitting surface 323. In the prism 32, the light entered through the light incident surface 321 is reflected at the light reflecting surface 322 to change its traveling direction by 90 degrees before being emitted through the light emitting surface 323. The prism 32 is formed of a material such as transparent glass or acrylic resin having a refractive index higher than that of air.

The light incident surface 321 is formed with a recess 324 extending in the primary scanning direction A1, A2. The recess 324 is provided for preventing the light incident surface 321 of the prism 32 from directly contacting the rod lenses 313 for preventing damage to the rod lenses 313. The light emitting surface 323 is formed with a recess 325 and projections 326 extending in the primary scanning direction A1, A2. The projections 326 project thicknesswise of the frame 30. When the print head 3 held in close contact with the photosensitive film 22 moves relative to the photosensitive film 22, only the projections 326 contact the photosensitive film 22. Thus, the prism 32 is so structured that the print head 3 contacts the photosensitive film 22 at a minimal possible contact area and with a minimal possible contact resistance even when the light-exposure is performed with the print head 3 kept in close contact with photosensitive film 22. As a result, the print head 3 can move smoothly relative to the photosensitive film 22 while minimizing damage to the photosensitive film 22 by the prism 32. Further, the provision of the projections 326 in the prism 32 prevents the light emitting region (recess 324) of the prism 32 from being damaged, making it possible to perform proper light emission.

Figure 7:
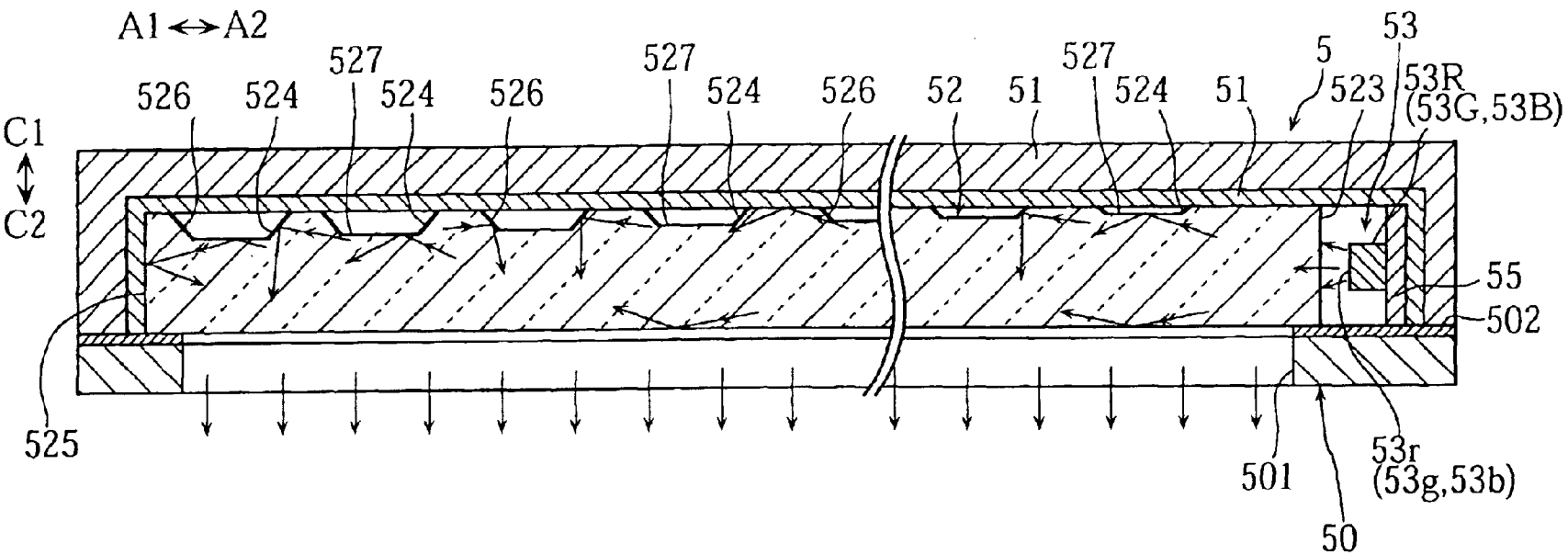
FIG. 7 is a sectional view of the illuminator.

As shown in FIGS. 4 and 7, the illuminator 5 of the stack unit 4 comprises a light guide 52 and a light source device 53 which are accommodated in a space defined by a first and a second light shields 50 and 51.

Figure 6:
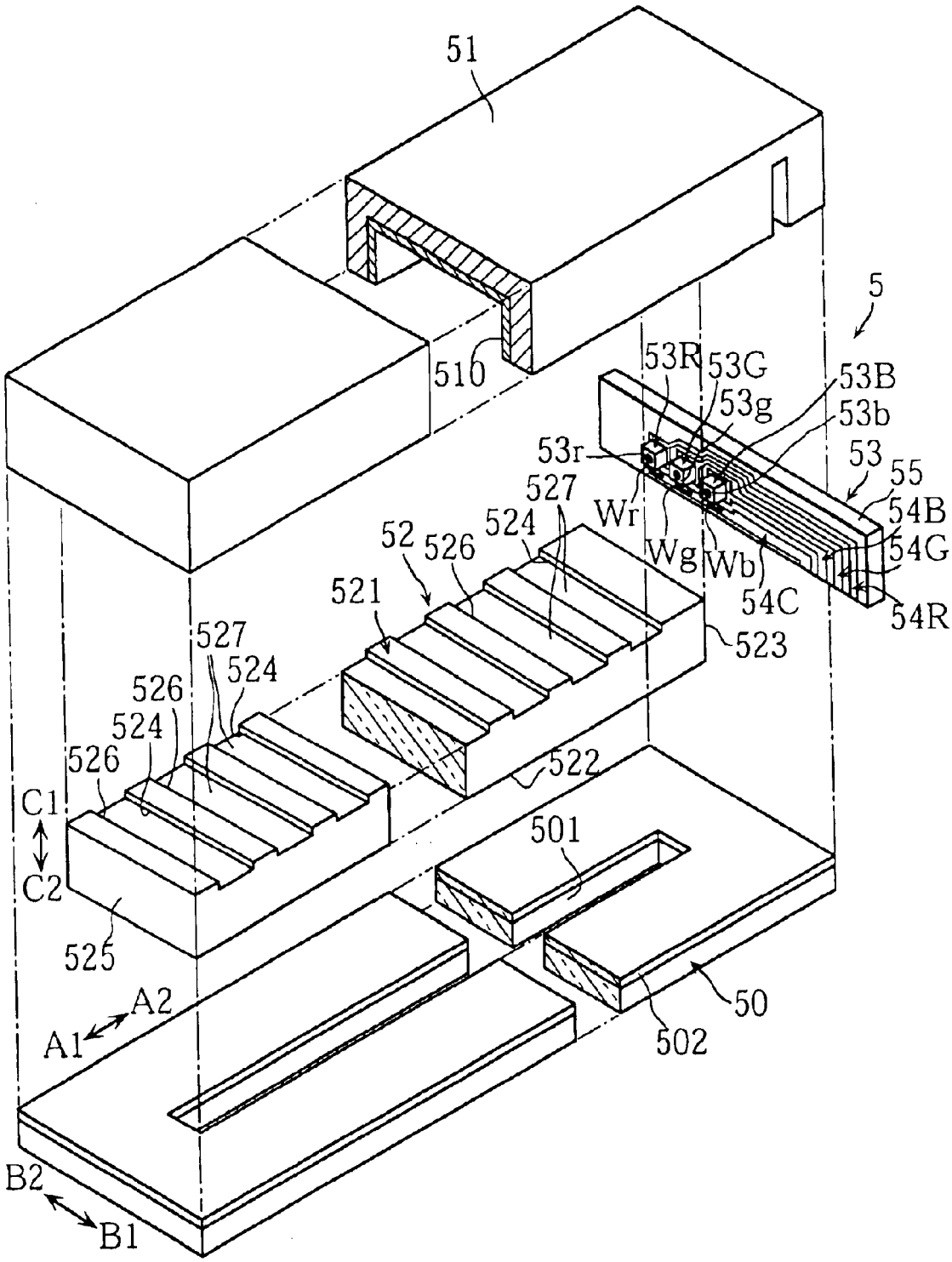
FIG. 6 is an exploded perspective view of an illuminator.

As clearly shown in FIGS. 6 and 7, the light guide 52 is in the form of a bar. The light guide 52 includes a light reflecting surface 521 and a light emitting surface 522 spaced thicknesswise from each other, and a light incident surface 523 comprising an end surface. Preferably, each of the surfaces 521-523 of the light guide 52 is a mirror surface. The light reflecting surface 521 includes a plurality of first inclined surfaces 524 inclined toward the light incident surface 523, and a plurality of second inclined surfaces 526 inclined toward an end surface 525 opposite to the light incident surface 523. The first inclined surfaces 524 reflect the light traveling from the light incident surface 523 for directing the light toward the light emitting surface 522. The second inclined surfaces 526 reflect the light traveling from the end surface 525 for directing the light toward the light emitting surface 522. The inclined surfaces 524 and 526 are formed by the provision of a plurality of recesses 527 at an obverse surface of the light guide 52 so that the angle of inclination becomes 45 degrees or substantially 45 degrees. The recesses 527 are arranged at a pitch of 200 $\mu$m, for example, and have progressively increasing depths away from the light incident surface. The recess 527 closest to the light incident surface 523 may have a depth of 0.35 $\mu$m, for example, whereas the recess 527 farthest from the light incident surface 523 may have a depth of 0.90 $\mu$m, for example.

The first light shield 50 is provided to cover the light emitting surface 522. The light shield 50 is formed with an opening 501 extending in the primary scanning direction A, B. The second light shield 51 has a box-like shape for accommodating the light guide 52. The first and the second light shields 50 and 51 may be formed by molding a resin such as PC or PMMA which is colored black. The first light shield 50 has an obverse surface provided with a reflector 502 for close contact with the light emitting surface 522. The second light shield 51 is inwardly formed with a reflector 510. The reflectors 502 and 510 may be formed by applying a white paint or attaching a white sheet, for example. The reflectors 502 and 510 may be formed by applying a metal film such as aluminum or may directly be formed on the surfaces of the light guide 52.

Figure 8:
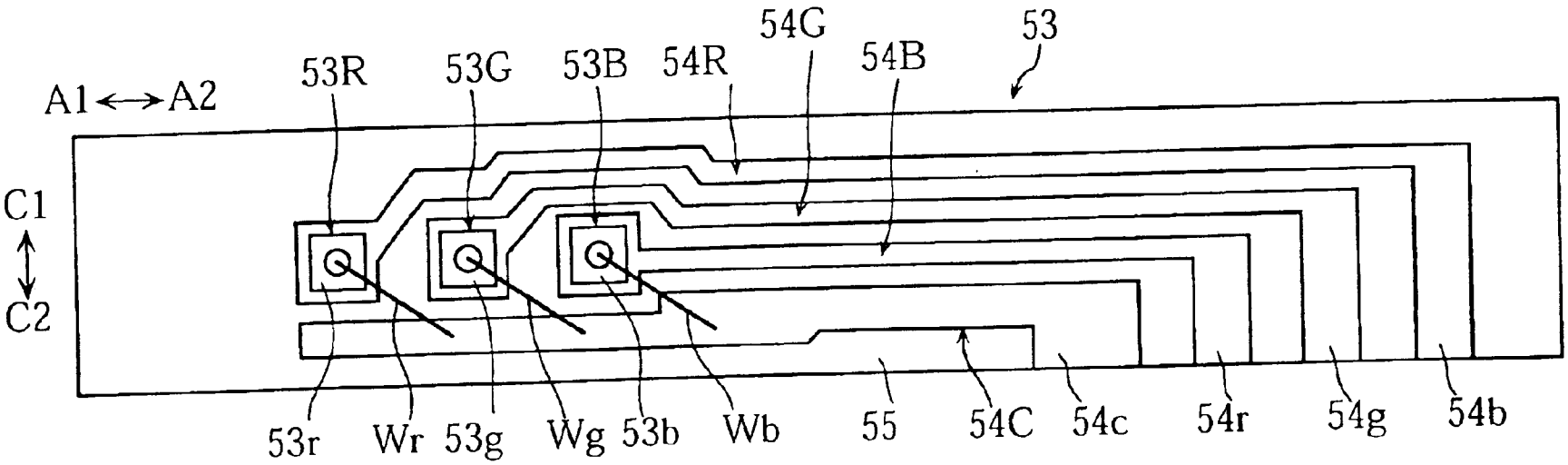
FIG. 8 is a plan view of a light source device.

As shown in FIGS. 6 and 8, the light source device 53 comprises three point light sources 53R, 53G and 53B mounted on an insulating substrate 55. The point light sources 53R, 53G and 53B comprise LED bare chips. The point light source 53R emits red light, the point light source 53G emits green light and the point light source 53B emits blue light. Each of the point light sources 53R, 53G and 53B has upper and lower surfaces formed with electrodes (not shown). The upper surface electrodes comprise transparent electrodes formed of e.g. ITO and their obverse surfaces 53*r*, 53*g* and 53*b* serve as light emitting surfaces.

The insulating substrate 55 is formed with individual wirings 54R, 54G and 54B, and a common wiring 54C. The point light sources 53R, 53G and 53B are mounted on the individual wirings 54R, 54G and 54B, respectively. The point light sources 53R, 53G and 53B are aligned in the secondary scanning direction B1, B2 with their lower surface electrodes electrically connected to the individual wirings 54R, 54G and 54B, respectively. The upper surface electrodes of the point light sources 53R, 53G and 53B are connected to the common wiring 54C via conductor wires Wr, Wg and Wb, respectively. The conductor wires Wr, Wg and Wb extend in a direction transverse to the width direction C1, C2 of the insulating substrate 55 (thicknesswise of the light guide 52). The light source device 5 is so held by the second light shield 51 that the respective light emitting surfaces 53*r*, 53*g* and 53*b* of the point light sources 53R, 53G and 53B face the light incident surface 523 of the light guide 52 and that respective end portions 54*r*, 54*g*, 54*b* and 54*c* of the wirings 54R, 54G, 54B and 54C are exposed. The end portions 54*r*, 54*g*, 54*b* and 54*c* are utilized for supplying power to the point light sources 53R, 53G and 53B for individually driving the point light sources 53R, 53G and 53B.

In the light source device 5, the three point light sources 53R, 53G and 53B are aligned on the insulating substrate 55 in the secondary scanning direction B1, B2 (i.e. perpendicularly to the thickness direction of the light guide 52). Further, the conductor wires Wr, Wg and Wb extend in a direction transverse to the width direction C1, C2 of the insulating substrate 55 (thicknesswise of the light guide 52). With such a structure, the width dimension of the insulating substrate 55, i.e. the dimension in the thickness direction C1, C2 of the light guide 52 can be made relatively small. Therefore, it is possible to reduce the thickness dimension of the print head 3 and hence the thickness dimension of the image forming apparatus X.

Figure 9:
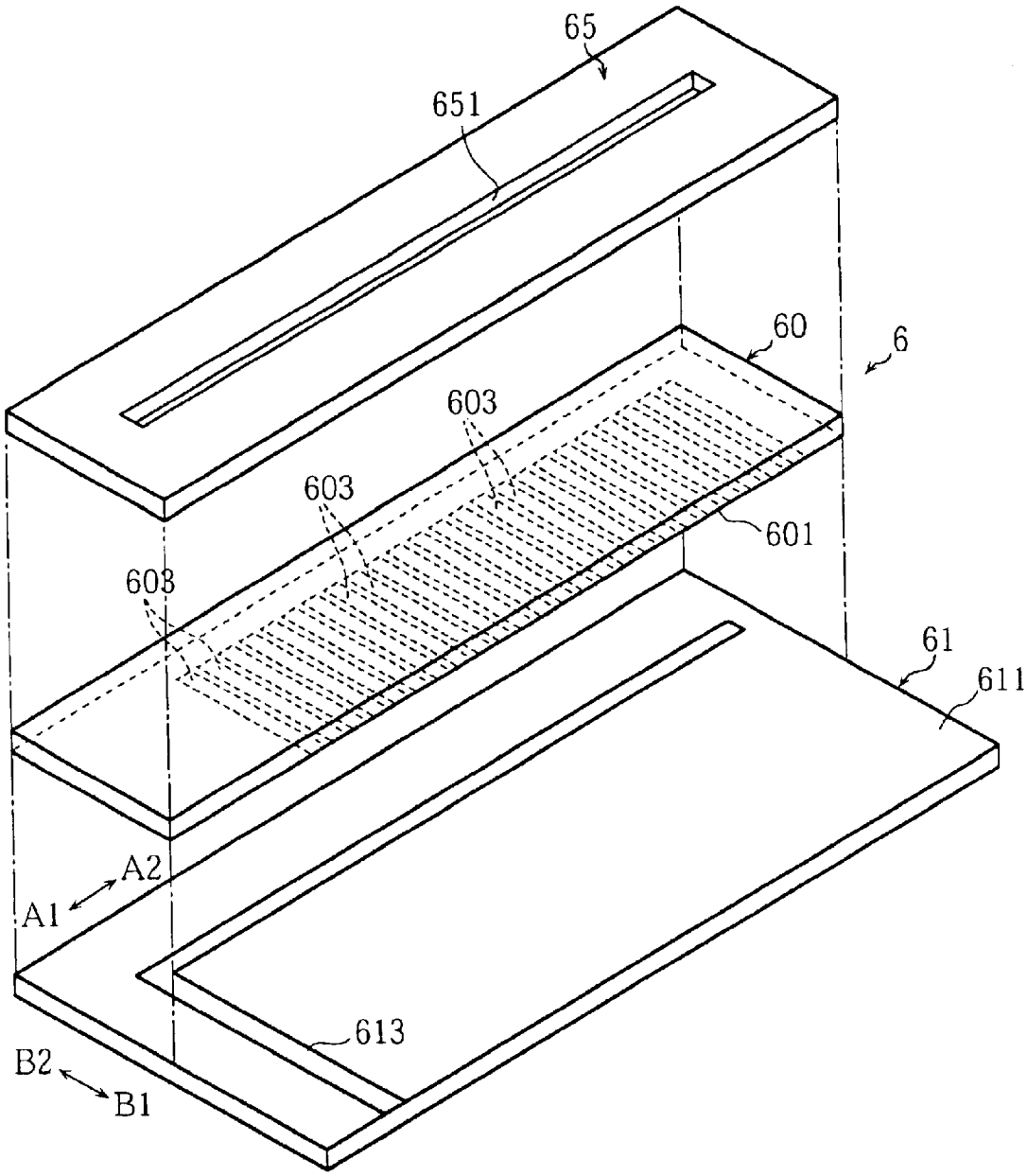
FIG. 9 is a perspective view illustrating a transparent substrate and a light shielding mask constituting a liquid crystal shutter.

As shown in FIGS. 5 and 9, the liquid crystal shutter 6 comprises a pair of transparent substrates 60 and 61, and liquid crystal 62 filled therebetween. As the liquid crystal 62, use may be made of ferroelectric liquid crystal or antiferroelectric liquid crystal. In ferroelectric liquid crystal or antiferroelectric liquid crystal, the direction of the spontaneous polarization readily changes in response to the change of the state of voltage application. Therefore, when ferroelectric liquid crystal or antiferroelectric liquid crystal is used for the liquid crystal shutter, the ON/OFF operation of individual shutter portions can be performed with high responsiveness, which realizes high-speed printing.

As the liquid crystal, nematic liquid crystal may also be used, and cyanide may preferably be used as a chiral dopant for twisting the liquid crystal. In such a case, the viscosity of the liquid crystal reduces so that the state of the liquid crystal readily changes in response to the change of the voltage application, which realizes high-speed printing.

Preferably, cyanide may be added in an amount of 0.1–4.0 parts by weight relative to 100 parts by weight of the liquid crystal, and the viscosity of the liquid crystal may be 10–20 mPa·s.

Figure 10:
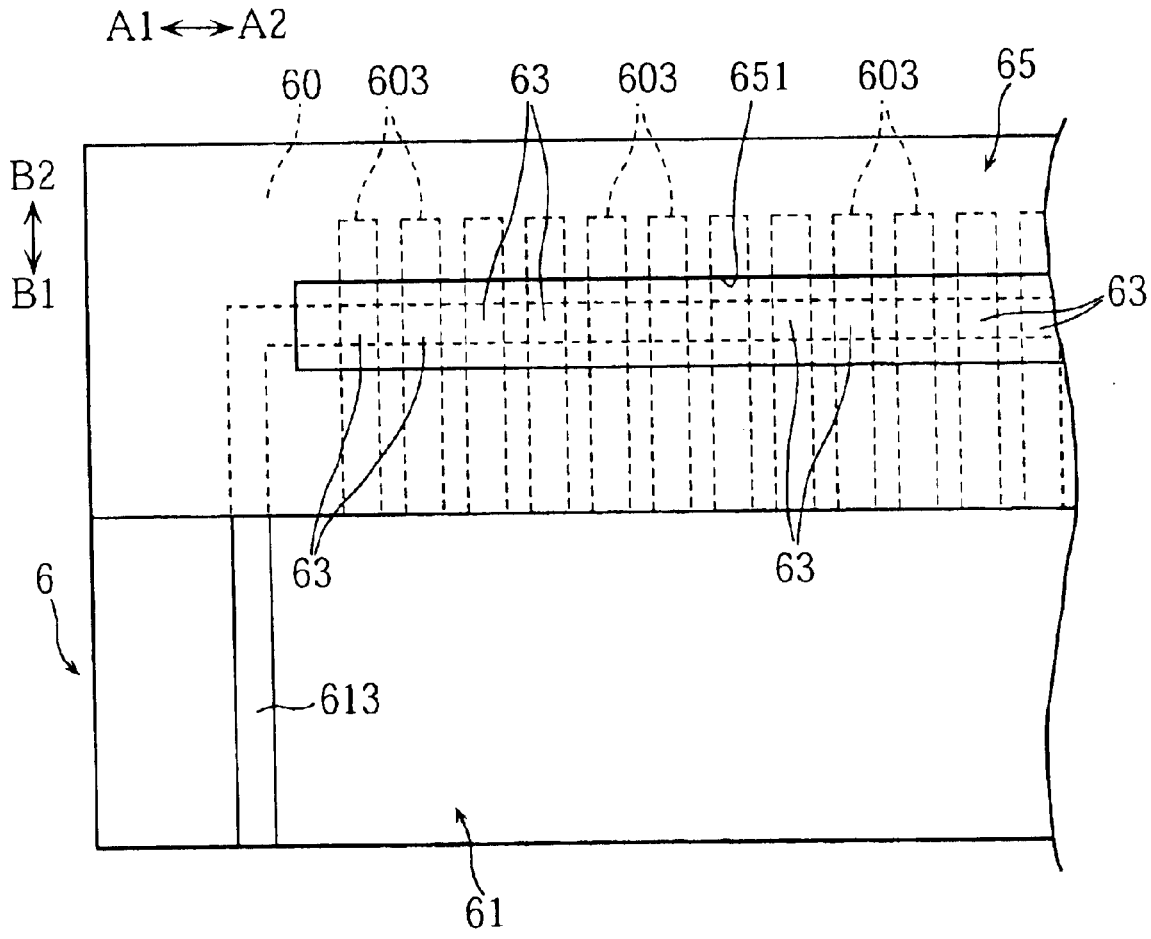
FIG. 10 is a plan view of a principal portion of the liquid crystal shutter.

As clearly shown in FIGS. 9 and 10, the transparent substrate 60 has a facing surface 601 formed with a plurality of segment electrodes 603 each in the form of a strip. The transparent substrate 61 has a facing surface 611 formed with a common electrode 613. The common electrode 613 includes a portion successively crossing the plural segment electrodes 603. The portions where the segment electrodes 603 cross the common electrode 613 serve as individual shutter portions 63. The shutter portions 63 are arranged in a row extending in the primary scanning direction A1, A2 at a location directly below the opening 501 of the first light shield 50. The segment electrodes 603 and the common electrode 613 are transparent electrodes formed of ITO, for example. When nematic liquid crystal is used as the liquid crystal, an alignment layer is provided to individually cover the segment electrodes 603 and the common electrode 613.

As shown in FIG. 5, the transparent substrates 60 and 61 have non-facing surfaces 602 and 612 respectively provided with polarizers 604 and 614. The polarizers 604 and 614 are so arranged that respective polarization axes extend perpendicularly to each other. For example, therefore, the light passing through the polarizer 604 and through the liquid crystal 62 changes its polarization direction by 90 degrees at a shutter portion 63 to which a voltage no less than a threshold value is applied, so that the light can pass through the polarizer 614. On the other hand, the polarization direction of the light does not change at a shutter portion 63 to which small (or no) voltage is applied, so that the light cannot pass through the polarizer 614. Thus, the selection of light passing or light blocking can be performed with respect to each of the individual shutter portions 63 by controlling voltage application to the individual shutter portions 63.

Figure 11:
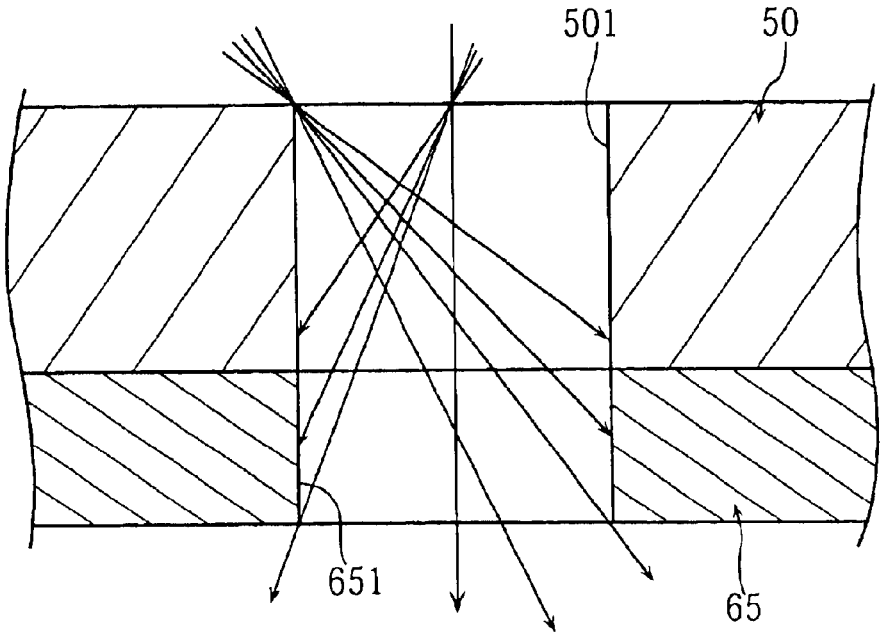
FIG. 11 is an enlarged sectional view of a principal portion around openings of the first light shield and the light shielding mask.

A drive IC 64 is mounted on the facing surface 611 of the transparent substrate 61. The drive IC 64 is connected to a flexible cable 641 via a wiring 640. The flexible cable 641 comprises an insulating flexible substrate 642 and a wiring 643 formed thereon as a pattern. Power supply or transmission of various signals to the drive IC 64 is performed through the flexible cable 641. Though not clearly illustrated, the drive IC 64 is electrically connected to the point light sources 53R, 53G, 53B and to the segment electrodes 603 and the common electrode 613 of the liquid crystal shutter 6 via the individual wirings 54R, 54G, 54B and the common wiring 54C. Therefore, the drive IC 64 causes the point light sources 53R, 53G and 53B to turn on and off and controls light transmission or light blocking at each of the shutter portions 63. As shown in FIGS. 5 and 9, the non-facing surface 602 of the transparent substrate 60 is provided with a light shielding mask 65. The light shielding mask 65 is formed with an opening 651 extending in the primary scanning direction A1, A2. As shown in FIG. 11, the opening 651 positionally corresponds to the opening 501 of the first light shield 50. The entire light shielding mask 65 including the inner surfaces of the opening 651 has high light absorptivity. Such a light shielding mask 65 may be formed by molding a black resin material.

In the image forming apparatus X, an image is formed on the photosensitive film 22 by exposing the photosensitive layer 222 (See FIG. 3) to light by the print head 3 followed by developing. The light exposure by the print head 3 may be performed based on the user's instructions for printing, for example.

For example, in exposing the photosensitive layer 222 (See FIG. 3), red light, green light and blue light are successively emitted from the print head 3 so that the photosensitive film 22 is irradiated with light of the three colors along a same line. Such linear exposure is repeated while pitch-feeding the print head 3.

As shown in FIG. 7, for emitting light from the print head 3, the point light source 53R (53G, 53B) of the light source device 5 of the color to be emitted from the print head 3 is turned on. Turning on and off of the point light sources 53R, 53G and 53B are controlled by the drive IC 64 (See FIG. 5). In this way, by turning on the point light source 53R (53G, 53B), light from the point light source 53R (53G, 53B) is guided into the light guide 52 through the light incident surface 523.

Light travels within the light guide 52 while being repetitively reflected by the light reflecting surface 521 or the light emitting surface 522. The light incident on the first or the second inclined surface 524, 526 is reflected at that surface and travels toward the light emitting surface 522. Since the inclined surfaces 524, 526 are inclined about 45 degrees for example, the light reflected by the inclined surface 524, 526 becomes incident on the light emitting surface 522 at an angle smaller than the critical angle for total reflection before emitting from the light emitting surface 522.

Since the illuminator 5 is covered with reflectors 502 and 510, the light emitted from the light guide 52 is basically reflected by the reflectors 502 and 510 for returning to the light guide 52 except for the light passing through the opening 501 of the first light shield 50. Therefore, the light emitted from the point light sources 53R (53G, 53B) can be effectively utilized. Since the light utilization efficiency is enhanced in this way, the illuminator 5 with a small number of light sources (three in this embodiment) can emit light of an amount sufficient for developing the photosensitive film 22. As a result, it is possible to decrease the power consumption of the illuminator 5 and hence the power consumption of the print head 3.

Light passing through the reflector 502, 510 is absorbed by the first or the second light shield 50, 51. Therefore, light is not emitted from the illuminator 5 except through the opening 501 so that the photosensitive film 22 is prevented from being exposed to leakage light from the illuminator 5. In the light guide 52 of this embodiment, the farther a recess 527 is from the light incident surface 523, the larger its depth is and the more largely the inclined surface 524, 526 project toward the light emitting surface 522. On the other hand, a smaller amount of light reaches a portion located farther from the light incident surface 523. Therefore, the light guide is so designed that light reflection toward the light emitting surface 522 occurs more efficiently at a portion farther from the light incident surface 523, thereby preventing the amount of light from varying in the primary scanning direction A1, A2 in the light guide 52.

The light emitted from the light emitting surface 522 passes through the opening 501 of the first light shield 50 and the opening 651 (See FIG. 5) of the light shielding mask 65 to enter the liquid crystal shutter 6. As is clear from FIG. 11, only the light incident on the first light shield 50 or the light shielding mask 65 at a relatively small incident angle can pass through the openings 501, 651 without being absorbed by the first light shield 50 or the light shielding mask 65. Therefore, the provision of the openings 501 and 651 of the first light shield 50 and the light shielding mask 65 gives high directivity to light entering the liquid crystal shutter 6. Such an advantage can be obtained even when one of the first light shield 50 and the light shielding mask 65 is eliminated.

In the liquid crystal shutter 6, under the control by the drive IC 64, light transmitting or light blocking is selected for each of the plural shutter portions 63 (See FIG. 10) based on the image data. The light passing through the liquid crystal shutter 6 is regularly reflected by the reflector 33, thereby changing its traveling direction by 90 degrees before entering the rod lens array 31. At the rod lens 313, the light traveling at an angle larger than the opening angle of the lens 313 cannot enter the rod lens 313. Since the directivity of light is enhanced by the first light shield 50 or the light shielding mask 65, it is possible to make light efficiently enter the rod lens 313.

The light entering the rod lens array 31 pass through each rod lens 313 and then enters the prism 32 through the light incident surface 321. The light entering the prism 32 changes its traveling direction by 90 degrees at the light reflecting surface 322 and travels downward in the prism 32 before being emitted through the light emitting surface 323. The light is converged onto the photosensitive film 22 for irradiating the photosensitive film 22 along a line.

The developing of the photosensitive film 22 is performed in transferring the photosensitive film 22 after the light exposure, as shown in FIG. 2. By moving the push bar 14 in the arrow B2 direction, the photosensitive film 22 after light exposure is moved in the B2 direction. As a result, an end edge of the photosensitive film 22 is discharged through the third opening 215 of the case 21. When the end edge of the photosensitive film 22 reaches the platen rollers 15, the photosensitive film 22 is transferred between the two platen rollers 15 by the rotation of the rollers 15. When the photosensitive film passes between the platen rollers 15, a pressing force is exerted on the developer retaining pack 224 (See FIG. 3) provided at the end edge of the photosensitive film 22. As a result, the developer is pushed out from the end edge side to into wetting contact with the opposite surfaces of the photosensitive layer 222. As the photosensitive film 22 passes between the platen rollers 15, the developer is spread toward the rear edge side of the photosensitive film 222 (See FIG. 3). When the photosensitive film 22 completely passes the platen rollers 15, the developer is spread to the entirety of the photosensitive film 222 (See FIG. 3). Thus, developing of the photosensitive film 222 (See FIG. 3) is completed. The photosensitive film 22 after developing is transferred by the platen rollers 15 for discharge from the housing 1 through the discharge port 131 (See FIG. 1).

Figure 12:
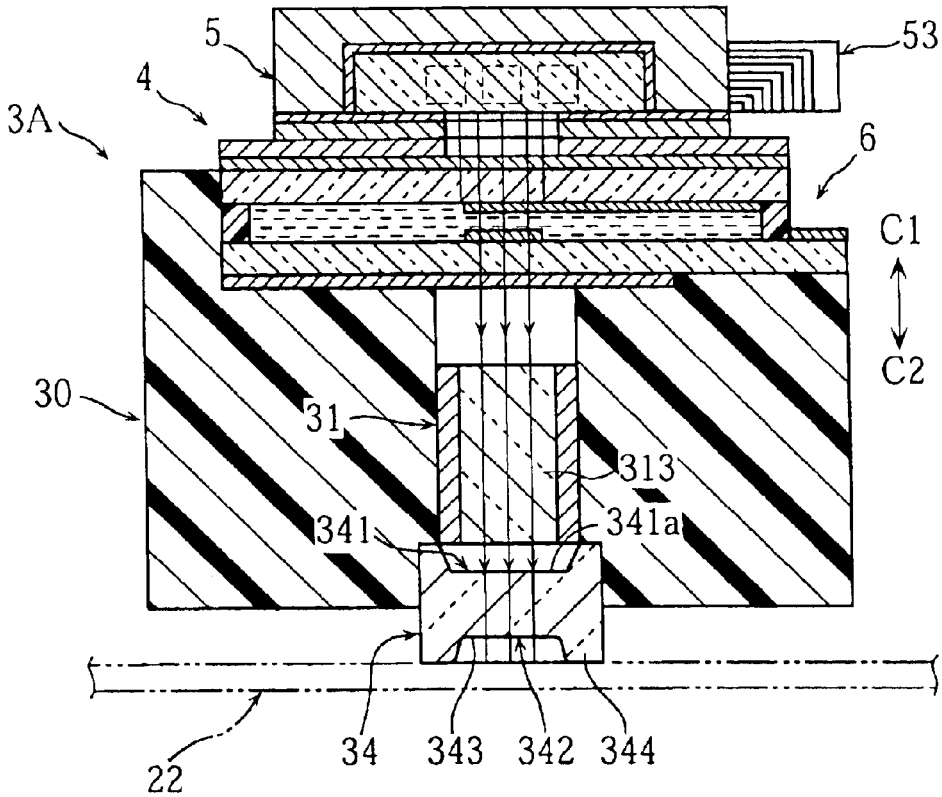
FIG. 12 is a sectional view illustrating a print head according to a second embodiment of the present invention.

Next, with reference to FIG. 12, description will be made of a print head according to a second embodiment of the present invention. In FIG. 12, the elements which are identical or similar to those of the above-described print head 3 (See FIGS. 4 and 5, for example) are designated by the same reference signs.

The print head 3A includes a lens array 31 including rod lenses 313 which are so oriented that their lens axes extend in the thickness direction C1, C2 of the frame 30. The print head 3A includes a transparent bar-like member 34 arranged at the light emitting side of the lens array 31.

The bar-like member 34 includes a light incident surface 341 and a light emitting surface 342. The light incident surface 341 is formed with a recess 341*a*. The recess 341*a* is provided for preventing the bar-like member 34 from directly contacting the rod lenses 313 for preventing damage to the rod lenses 313. The light emitting surface 342 is formed with a recess 343 and projections 344 extending in the primary scanning direction (i.e. in the direction perpendicular to the sheet surface). The projections 344 project in the thickness direction C1, C2 of the frame 30. When the print head 3 held in close contact with the photosensitive film 22 moves relative to the photosensitive film 22, only the projections 344 contact the photosensitive film 22. That is, the prism 32 is so structured that the print head 3 contacts the photosensitive film 22 at a minimal possible contact area and with a minimal possible contact resistance even when the light-exposure is performed with the print head 3 kept in close contact with photosensitive film 22. As a result, the print head 3 can move smoothly relative to the photosensitive film 22 while minimizing damage to the photosensitive film 22.

Figure 13A:
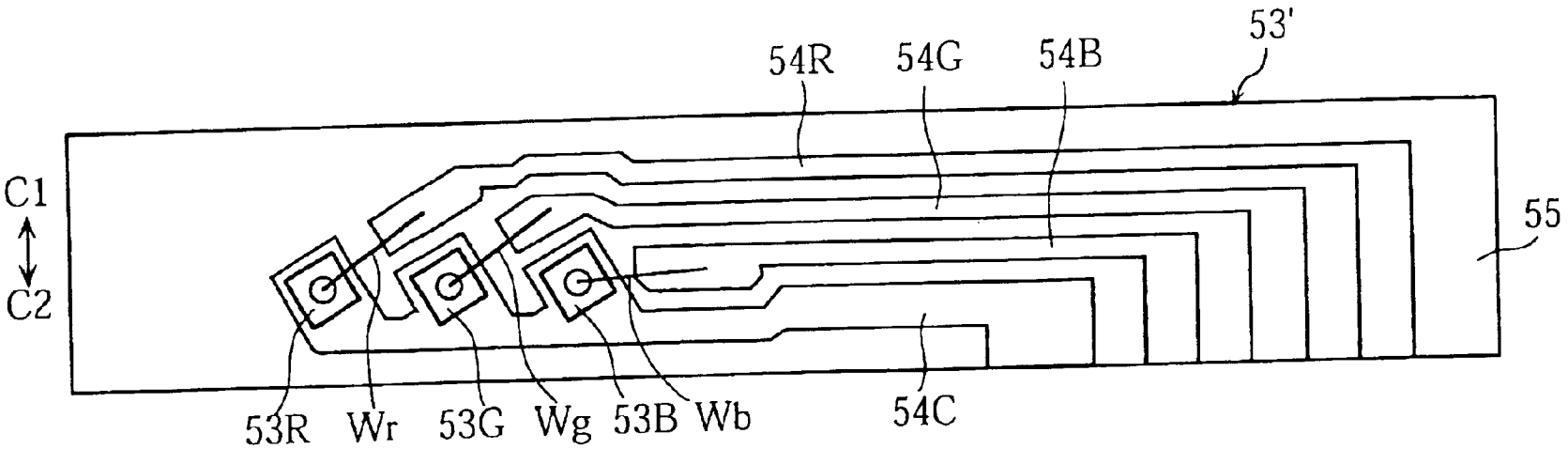
FIGS. 13A and 13B are plan views illustrating other examples of light source device.
Figure 13B:
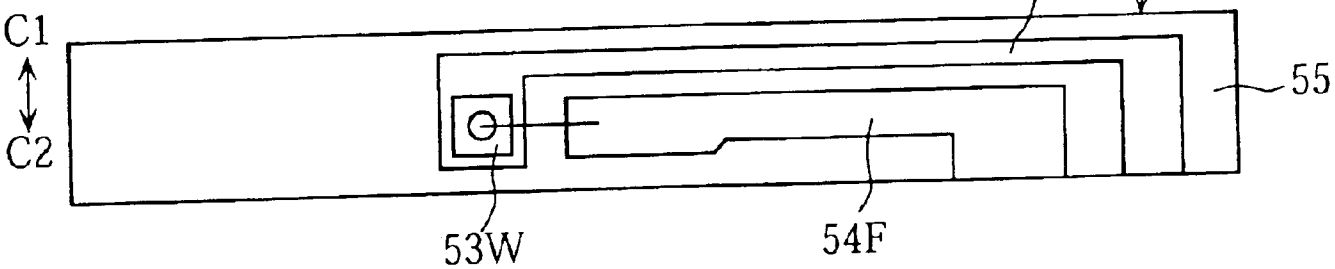

The print head 3, 3A according to the first and the second embodiments may utilize light source devices as shown in FIGS. 13A and 13B.

In the light source device 53' shown in FIG. 13A, point light sources 53R, 53G and 53B are mounted with respective lower electrodes brought into close contact with a common electrode 54*c*, while respective upper electrodes are connected to the individual wirings 54R, 54G and 54B via conductor wires Wr, Wg and Wb, respectively.

Figure 14:
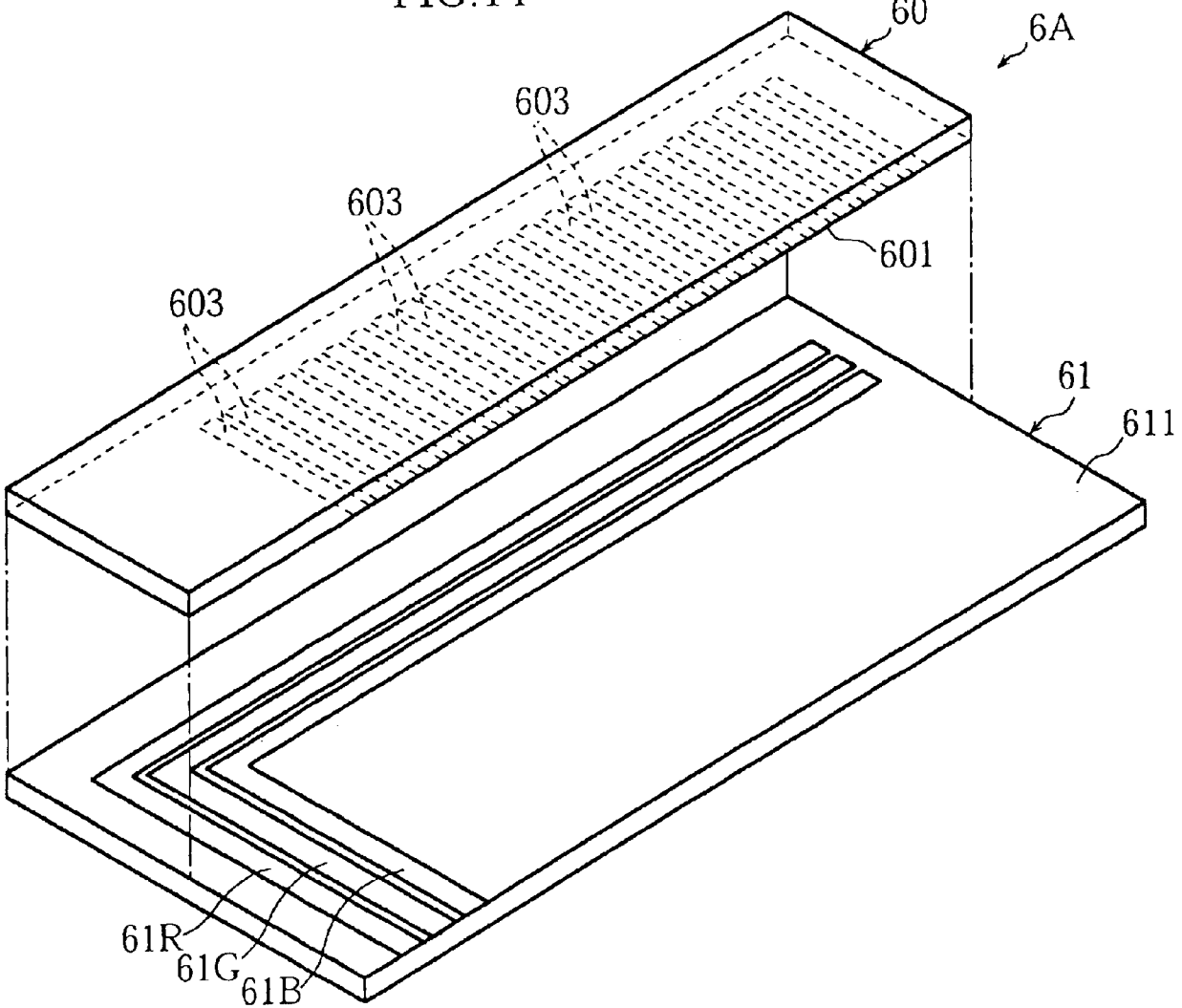
FIG. 14 is a perspective view of transparent substrates of another example of liquid crystal shutter.

The light source device 53" shown in FIG. 13B comprises an insulating substrate 55 provided with two wirings 54F and 54H, and a white point light source 53W as a point light source for emitting white light. In this case, a liquid crystal shutter 6A as shown in FIG. 14, for example, may be used for passing or blocking red light, green light and blue light. Specifically, the liquid crystal shutter 6A differs from the above-described liquid crystal shutter 6 (See FIG. 9) in that the transparent substrate 61 has a facing surface 611 formed with three common electrodes 61R, 61G and 61B. The transparent substrate 60 has a structure similar to that of the liquid crystal shutter 6 shown in FIG. 9, and the corresponding elements are designated by the same reference signs as those used in FIG. 9.

As can be inferred from FIG. 14, the liquid crystal shutter 6A includes three rows of shutter portions aligned with each other. The three rows consist of a row of first shutter portions for selecting whether or not red light is allowed to pass, a row of second shutter portions for selecting whether or not green light is allowed to pass, and a row of third shutter portions for selecting whether or not blue light is allowed to pass. The selectivity for the light component at each of the shutter portions can be provided by arranging a color filter at the shutter portion, for example.

In such a liquid crystal shutter 6A, the use of the white point light source 53W combined with successive switching between the rows of the liquid crystal shutter provides light irradiation similar to that obtained by switching three kinds of point light sources 53R, 53G and 53B in the above-described print head 3 (FIGS. 4 and 5). Since the number of used light source is small in such a structure, the wirings 54F and 54H on the insulating substrate 55 can be simplified, which makes it possible to decrease the width dimension of the insulating substrate 55. Therefore, the thickness of the light guide and hence the thickness of the print head can be further reduced.

Instead of using the white point light source shown in FIG. 13B, white light may be emitted using the light source device 53 shown in FIG. 8 by turning on the three kinds of point light sources 53R, 53G and 53B at the same time. The white light obtained in this manner provides wavelength characteristics which exhibit peaks of light strength lies in the wavelength regions corresponding to red light, green light and blue light, respectively. When red light, green light or blue light is taken from the white light having such wavelength characteristics at the liquid crystal shutter 6A, the photosensitive film is prevented from being irradiated with a light component of unnecessary wavelength.

Figure 15A:
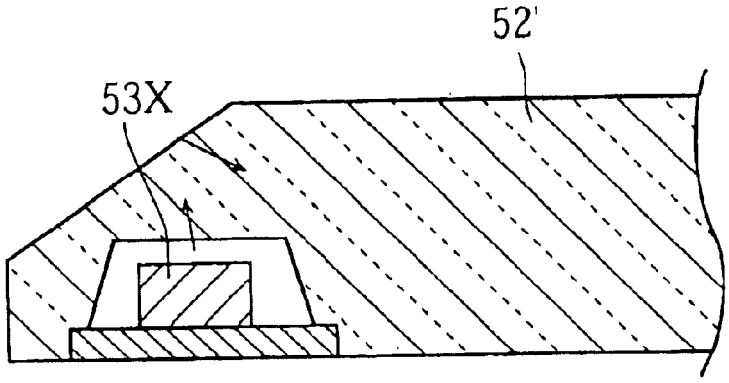
FIGS. 15A-15D each is a sectional view or a plan view illustrating another exemplary method for making light enter a light guide.
Figure 15B:
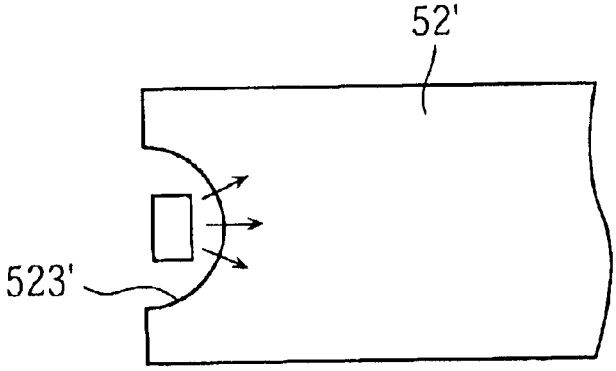
Figure 15C:
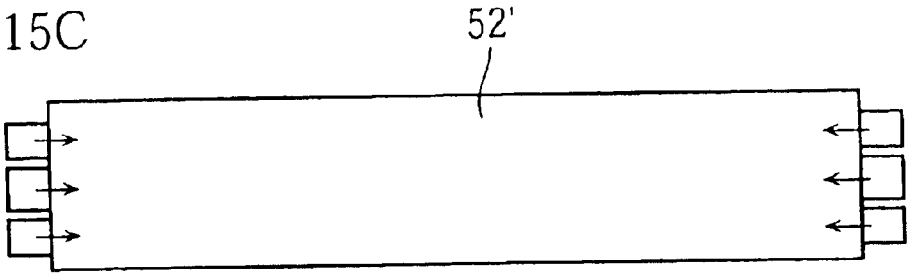
Figure 15D:
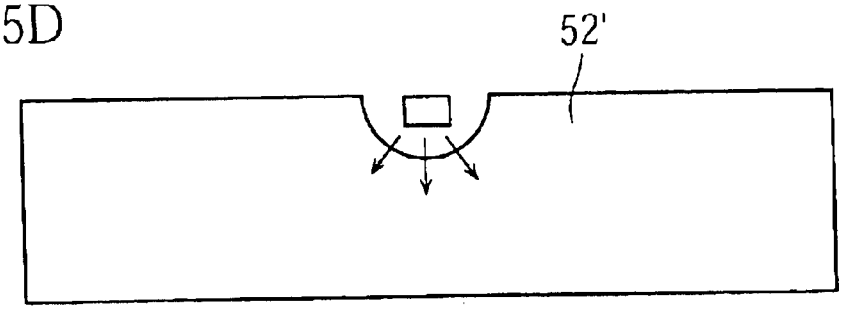
Figure 16:
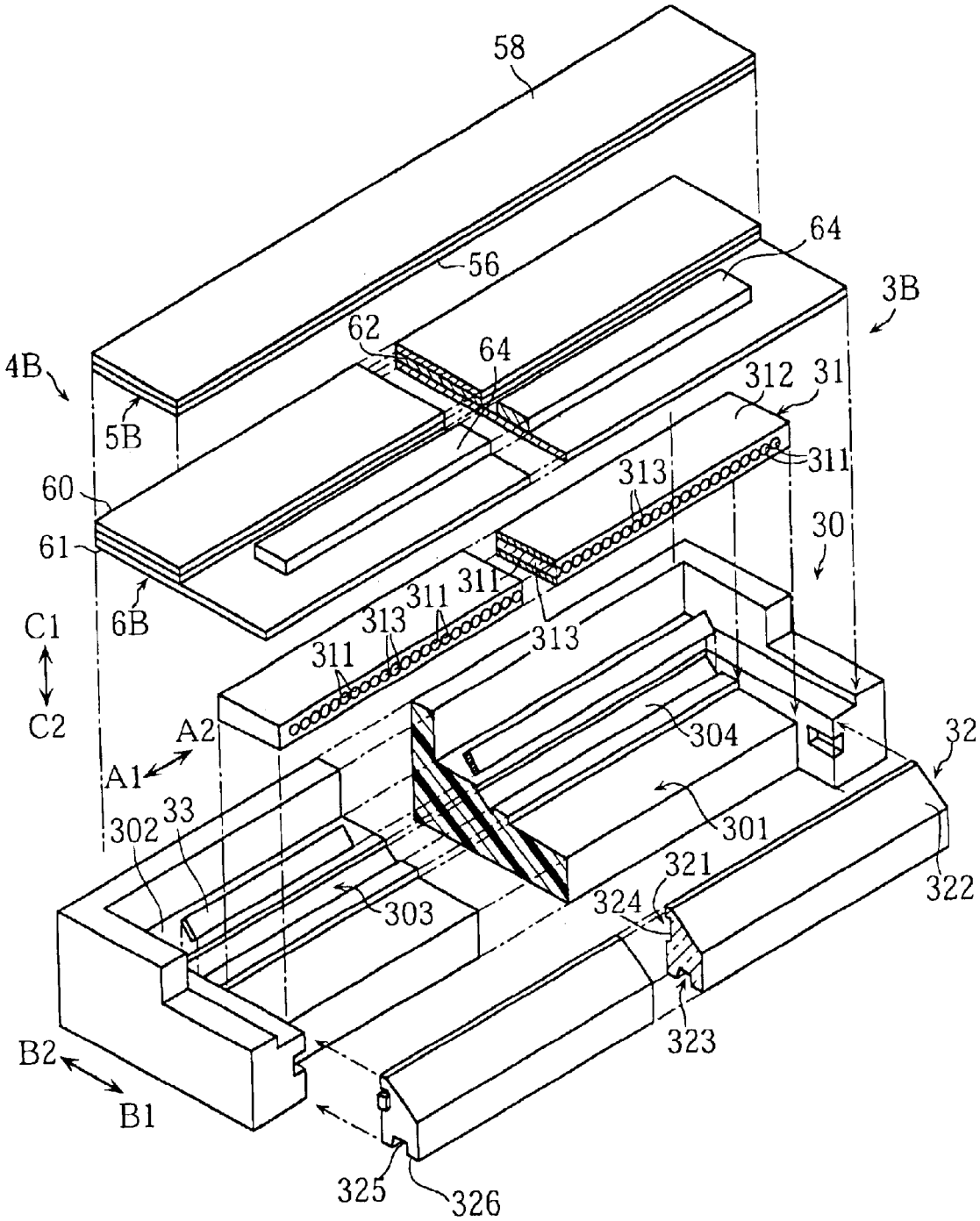
FIG. 16 is an exploded perspective view of a print head according to a third embodiment of the present invention.

As exemplarily illustrated in FIGS. 15A-15D, various methods may be utilized for causing light to enter a light guide 52'. FIG. 15A illustrates an example in which light is emitted upward from a point light source 53' for entering the light guide. FIG. 15B illustrates an example in which the light guide has an arcuate light incident surface 523'. FIG. 15C illustrates an example in which light enters from opposite ends of the light guide 52'. FIG. 15D illustrates an example in which light enters from a central portion of the light guide 52'. Further, the light guide may be made to have a progressively increasing thickness as it extends away from the light incident surface.

Next, with reference to FIGS. 16 through 21, a print head according to a third embodiment of the present invention will be described. The print head 3B shown in these figures differs includes a stack unit 4B which differs in structure from that of the above-described print head 3 (See FIGS. 4 and 5 for example) In FIGS. 16-21 referred to below, the parts or elements which are identical or similar to those of the above-described embodiments are designated by the same reference signs, and the description thereof will be omitted.

The stack unit 4B comprises a liquid crystal shutter 6B and an illuminator 5B stacked thereon via a light shielding mask 65B and a light diffusing layer 66B.

Figure 17:
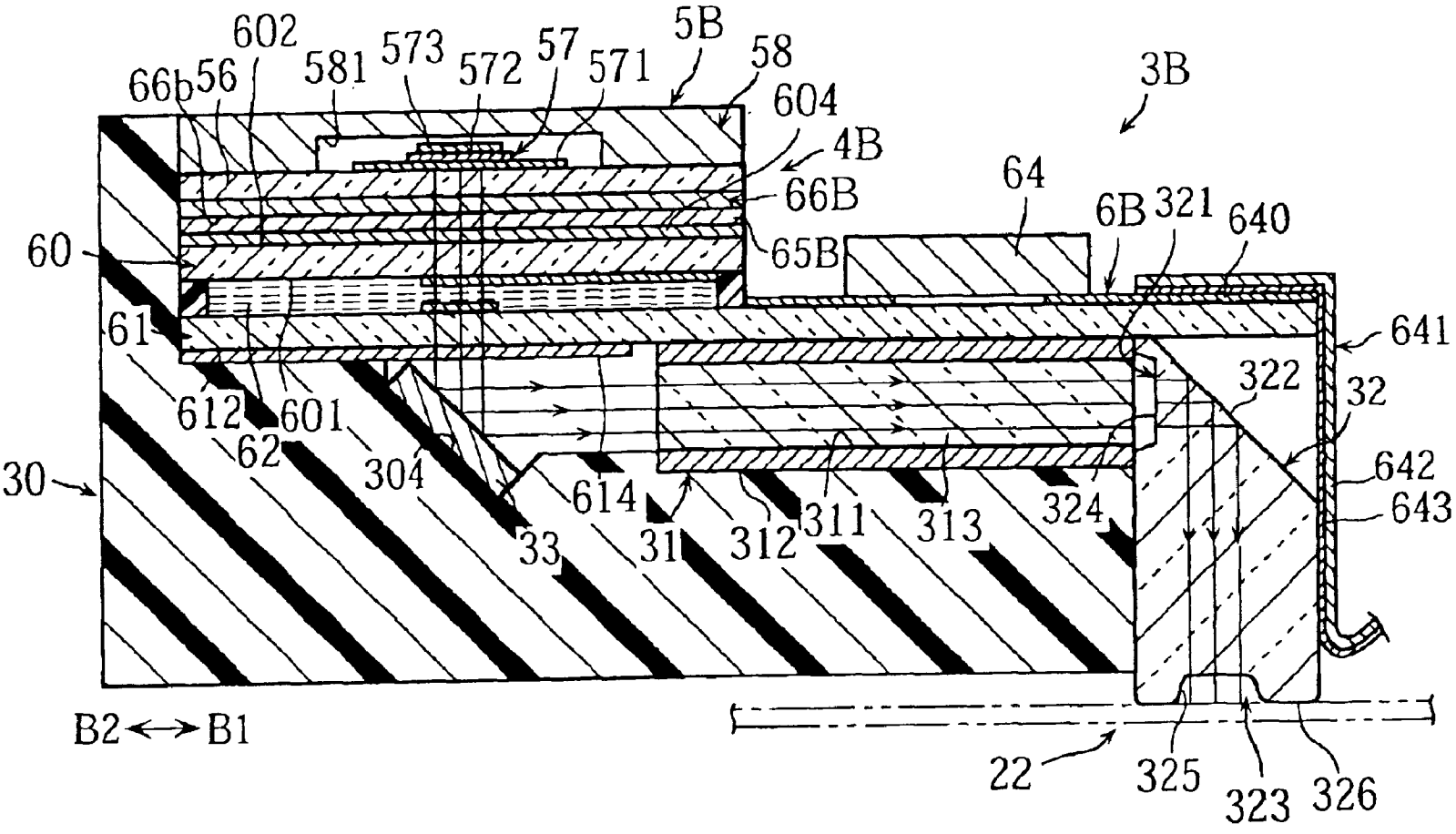
FIG. 17 is a sectional view of the print head shown in FIG. 16.
Figure 18:
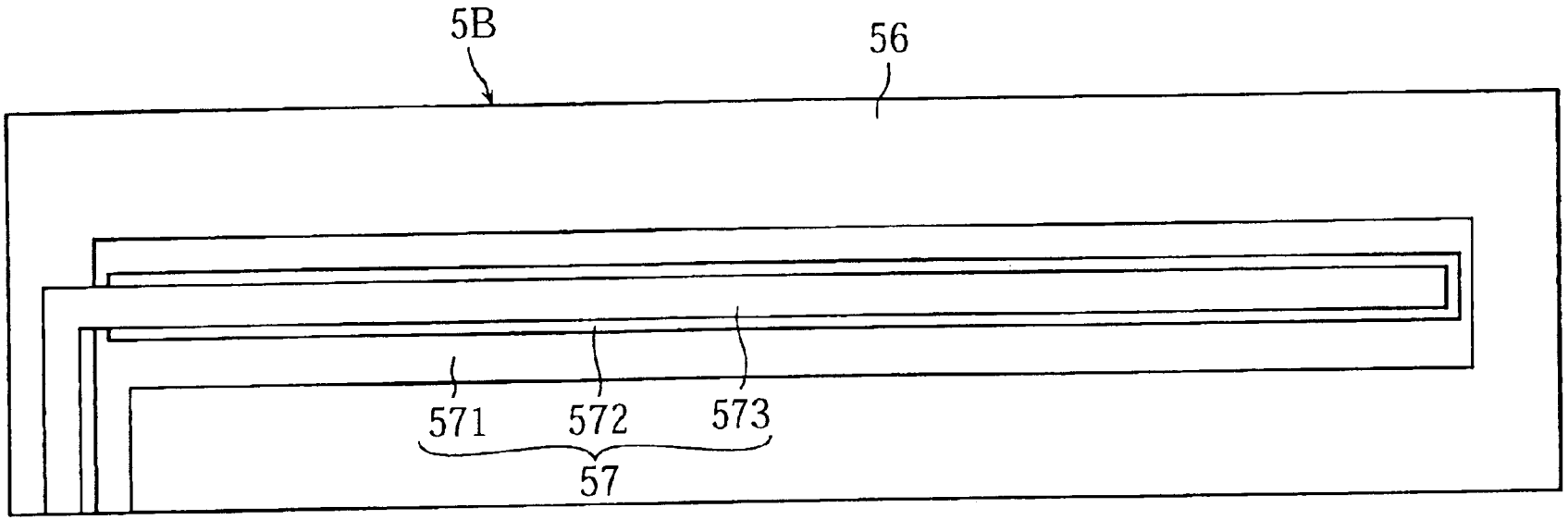
FIG. 18 is a plan view of a light source device.

As shown in FIGS. 17 and 18, the illuminator 5B comprises a transparent substrate 56 having an elongate rectangular configuration and a light source 57 mounted thereon. The light source 57 comprises an anode 571, an organic layer 572 and a cathode 573 stacked in the mentioned order. The anode 571 may be formed of e.g. ITO to be transparent. The cathode 573 may be formed of e.g. aluminum to be highly reflective.

The organic layer 572 includes a light emitting layer containing an organic luminous material. The light emitting layer in this embodiment emits visible light, e.g. white light, including red light, green light and blue light. When the light emitting layer contains a luminous material of low molecular weight for example, the organic layer 572 comprises a hole injection layer, a hole transfer layer, a light emitting layer, an electron transfer layer and an electron injection layer. When the light emitting layer contains a luminous material of high molecular weight, the organic layer 572 may comprise a hole transfer layer and a light emitting layer alone. Depending on the kind of a luminous material to be used, the organic layer 572 may have two-layer structure comprising an electron transfer layer and a light emitting layer or a three-layer structure comprising a hole transfer layer, an electron transfer layer and a light emitting layer.

When electric field is applied to the organic layer 572 through the anode 571 and the cathode 573, the light source 57 emits light. As clearly shown in FIG. 17, the light is emitted toward the liquid crystal shutter 6B through a transparent substrate 56.

The light source 57 is covered with a sealing portion 58. The sealing portion 58 includes a recess 581 for accommodating the light source 57 and is bonded to the transparent substrate 56 via an adhesive for example. The sealing portion 58 may be formed by working a glass plate. Alternatively, the sealing portion may be formed by applying and baking glass paste or applying molten or softened glass followed by drying the glass. With the provision of the sealing portion 58, the light source 57 is protected from external force. Further, since glass, which is an inorganic compound, is less likely to absorb water as compared with an organic compound, water from the surroundings is prevented from entering the light source 57, which prevents the light source 57 from being damaged.

The light diffusing layer 66B shown in FIG. 17 may be formed of a resin sheet containing beads dispersed therein, a resin sheet having a roughened surface or a glass plate. When light enters the light diffusing layer 66B, it is diffused in the light diffusing layer 66B, while the light incident on a light emitting surface 66*b* at an angle smaller than the critical angle for total reflection is emitted toward the liquid crystal shutter 6B. Therefore, the light emitting from the light diffusing layer 66B has a low emission angle and a high directivity. Further, by diffusing light in the light diffusing layer 66B before entering the liquid crystal shutter 6B, it is possible to uniform the amount of light which may initially include variation due to the existence of a portion emitting a smaller amount of light in the light source 57, for example. Thus, the provision of the light diffusing layer 66B makes it possible to uniform the amount of light in the primary scanning direction A1, A2.

Figure 19A:
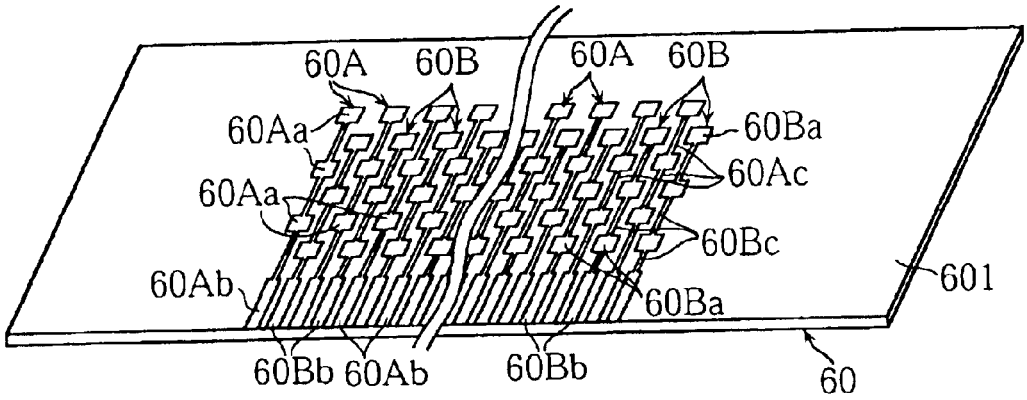
FIGS. 19A and 19B each is a perspective view illustrating a substrate constituting a liquid crystal shutter.
Figure 19B:
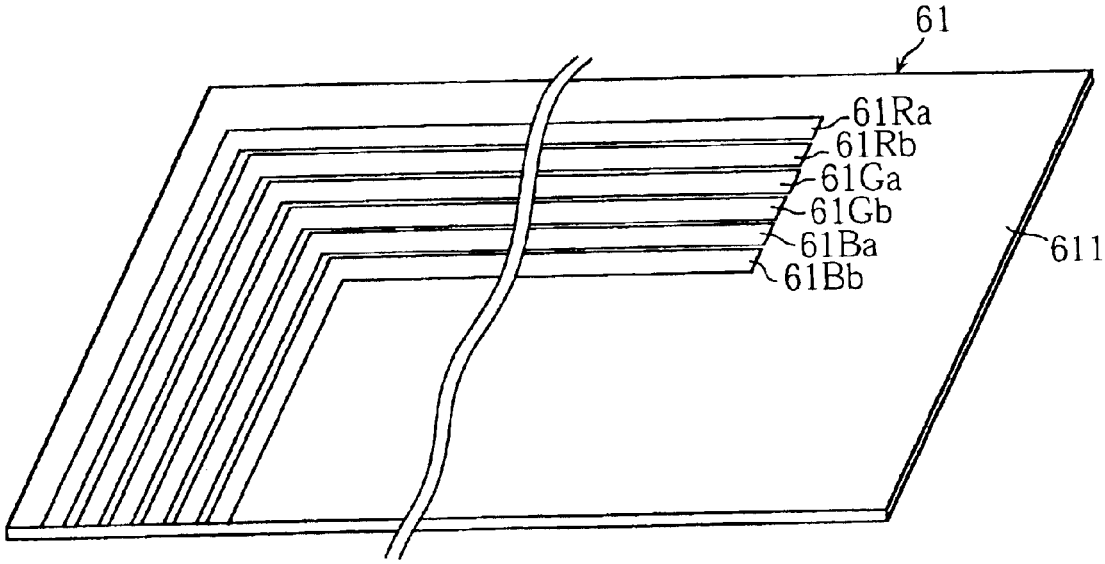

As shown in FIG. 17, the liquid crystal shutter 6B comprises a pair of transparent substrates 60 and 61, and liquid crystal 62 filled therebetween. As shown in FIGS. 19A and 19B, the transparent substrate 60 has a facing surface 601 formed with a plurality of segment electrodes 60A and 60B, whereas the transparent electrode 61 has a facing surface 611 formed with common electrodes 61Ra, 61Rb, 61Ga, 61Gb, 61Ba and 61Bb. The segment electrodes 60A, 60B and the common electrodes 61Ra, 61Rb, 61Ga, 61Gb, 61Ba, 61Bb may be formed of e.g. ITO to be transparent.

The segment electrodes 60A, 60B and the common electrodes 61Ra, 61Rb, 61Ga, 61Gb, 61Ba, 61Bb are covered with alignment layers (not shown). The alignment layer on the side of the segment electrodes 60A, 60B and the alignment layer on the side of the common electrodes 61Ra, 61Rb, 61Ga, 61Gb, 61Ba, 61Bb are so arranged that respective alignment directions extend perpendicularly to each other. Therefore, when no voltage is applied, the liquid crystal is twisted 90 degrees, for example. When a voltage is applied, the liquid crystal is released from the twisted state and oriented vertically. The twist angle of the liquid crystal may be made other than 90 degrees by adjusting the amount of chiral dopant added to the liquid crystal layer. As the liquid crystal, use maybe made of ferroelectric liquid crystal or antiferroelectric liquid crystal. In such a case, the alignment layers are eliminated. Since such kind of liquid crystal readily responds to the change of the state of voltage application, high-speed printing can be performed.

Figure 20:
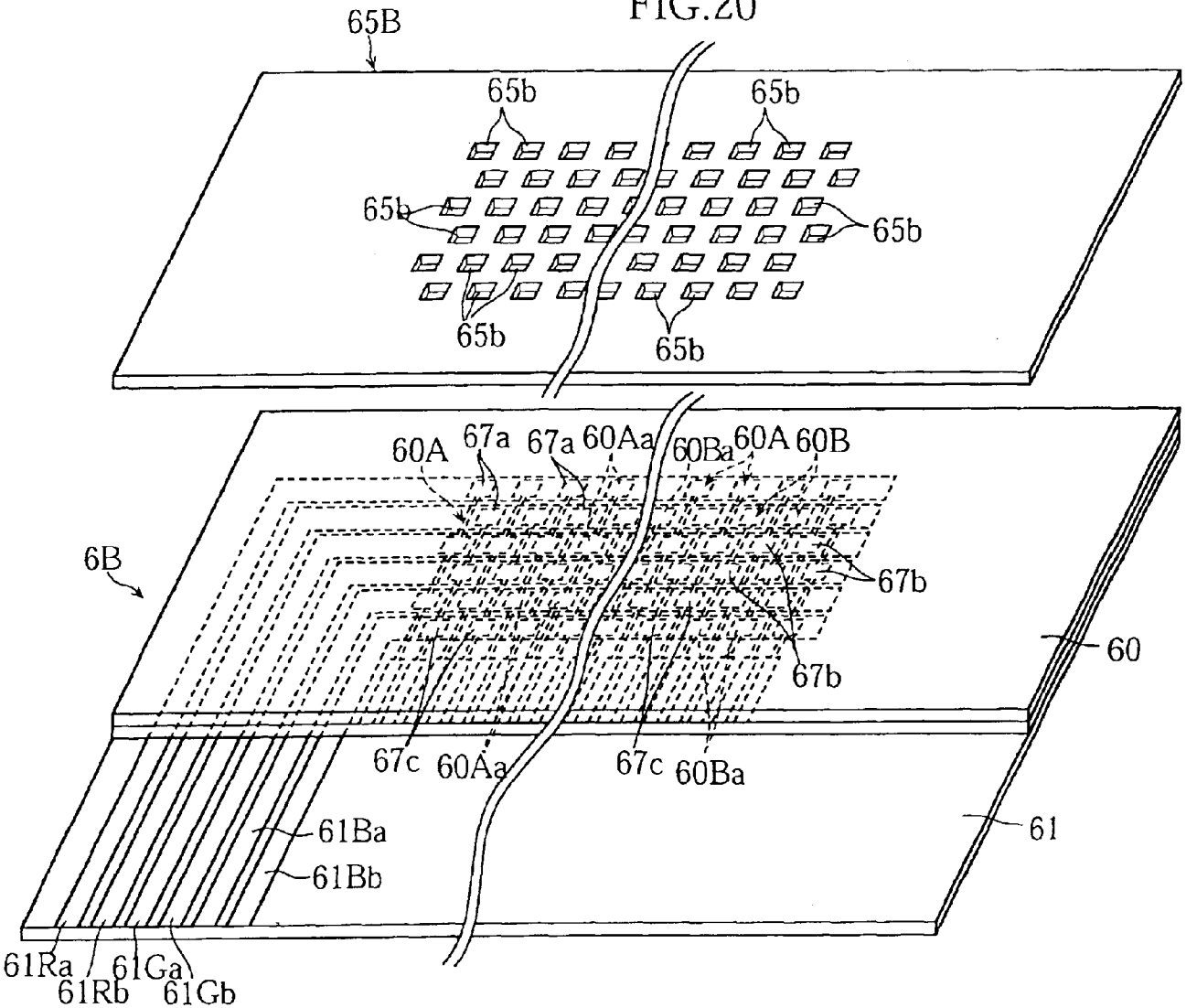
FIG. 20 is a perspective view illustrating a light shielding mask and a liquid crystal shutter.
Figure 21:
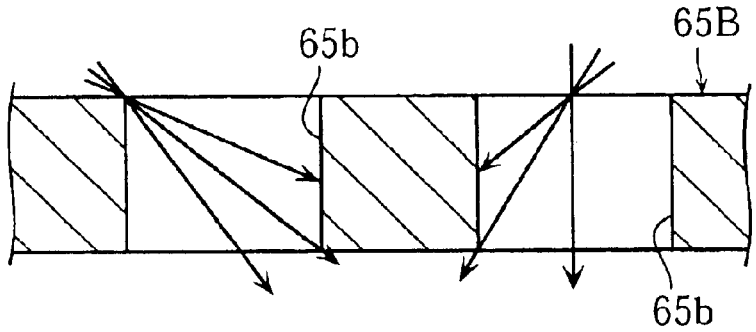
FIG. 21 is a sectional view of a principal portion of the light shielding mask.

Each of the segment electrodes 60A, 60B includes three pad portions 60Aa, 60Ba and a terminal pad 60Ab, 60Bb, which are connected to each other via connecting portions 60Ac, 60Bc having a width smaller than that of the pad portions 60Aa, 60Ba. As shown in FIG. 20, in the plan view of the liquid crystal shutter 6B, the pad portions 60Aa of the segment electrode 60A overlap the common electrode 61Ra, 61Ga, 61Ba, whereas the pad portions 60Ba of the segment electrode 60B overlap the common electrode 61Rb, 61Gb, 61Bb.

The portions where the pad portions 60Aa, 60Ba of the segment electrodes 60A, 60B overlap the common electrodes 61Ra, 61Rb constitute first shutter portions 67*a*. The portions where the pad portions 60Aa, 60Ba overlap the common electrodes 61Ga, 61Gb constitute second shutter portions 67*b*. The portions where the pad portions 60Aa, 60Ba overlap the common electrodes 61Ba, 61Bb constitute third shutter portions 67*c*. Thus, the first through the third shutter portions 67*a*–67*c* are respectively disposed in staggered relationship in two rows. With such an arrangement, the first through the third shutter portions 67*a*–67*c* can have relatively large areas while keeping a large space between adjacent shutter portions 67*a*–67*c*.

As shown in FIG. 17, the transparent substrates 60 and 61 have non-facing surfaces 602 and 612 respectively provided with polarizers 604 and 614. The polarizers 604 and 614 are so arranged that respective polarization axes extend in parallel to each other. Therefore, since the liquid crystal is not twisted at shutter portions 67*a*–67*c* to which voltage is applied, the light having passed the polarizer 604 does not change its vibration direction (polarization direction) in passing through the liquid crystal at that shutter portions and therefore is capable of passing through the polarizer 614. In contrast, at shutter portions 67*a*–67*c* to which no voltage is applied, the liquid crystal keeps its twist state, thereby changing the vibration direction (polarization direction) of the light passing therethrough for disabling the light to pass through the polarizer 614.

In this way, application or non-application of voltage selects whether or not light is caused to pass through the first through the third shutter portions 67*a*–67*c*. In this embodiment, though not clear from the figures, the first shutter portions 67*a* selectively pass red light, the second shutter portions 67*b* selectively pass green light, and the third shutter portions 67*c* selectively pass blue light. Such selectivity of passing light can be provided by attaching a red filter to the common electrodes 61Ra, 61Rb, a green filter to the common electrodes 61Ga, 61Gb, and a blue filter to the common electrodes 61Ba, 61Bb, for example. Color filters may be provided at the pad portions 60Aa, 60Ba of the segment electrodes 60A, 60B for passing light of a selected color.

As shown in FIG. 17, a drive IC 64 is mounted on the transparent substrate 61. Though not clearly illustrated in the figure, the drive IC 64 is electrically connected to the anode 571 and cathode 573 of the light source 57 and to the segment electrodes 60A, 60B and common electrodes 61Ra, 61Rb, 61Ga, 61Gb, 61Ba and 61Bb of the liquid crystal shutter 6B. Therefore, the drive IC 64 causes the light sources 57 to turn on and off and controls light passing or light blocking at the first through third shutter portions 67*a*–67*c*.

As shown in FIG. 20, the light shielding mask 65B is formed with a plurality of through-holes 65*b*. The through-holes 65*b* correspond to the first thorough third shutter portions 67*a*–67*c* and positioned directly above the shutter portions. The entire light shielding mask 65B including the inner surfaces of the opening through-holes 65*b* has high light absorptivity. Such a light shielding mask 65B may be formed by molding a black resin material.

Light emitted from the light diffusing layer 66B becomes incident on the light shielding mask 65B, and part of the incident light which has passed through the through-holes 65*b* enters the liquid crystal shutter 6B. As is clear from FIG. 21, only the light incident on the light shielding mask 65B at a relatively small incident angle can pass through the through-holes 65*b* without being absorbed by the light shielding mask 65B. Therefore, the provision of the light shielding mask 65 gives a high directivity to the light entering the liquid crystal shutter 6B (the first through the third shutter portions 67*a*–67*c*) Further, the through-holes 65*b* are provided directly above the first through the third shutter portions 67*a*–67*c* so that the light shielding mask 65B prevents light from becoming incident on the portions where the connecting portions 60Ac, 60Bc of the segment electrodes 60A, 60B overlap the common electrodes 61Ra, 61Rb, 61Ga, 61Gb, 61Ba and 61Bb. Therefore, even when potential difference is produced at the overlap portions to change the alignment state of the liquid crystal at the portions, it does not affect the light transmission or light blocking. Thus, it is possible to prevent unnecessary light from becoming incident on the liquid crystal shutter 6B and from passing through the liquid crystal shutter 6B.

In this print head 3B, irradiation of light on a same irradiation line is performed individually with respect to the three colors, i.e. red light, green light and blue light. As shown in FIGS. 17 and 18, in irradiating linear light, electric field is firstly applied to the organic layer 572 by the operation of the drive IC 64 for emitting linear light from the light source 57. The linear light travels through the transparent substrate 60 and the light diffusing layer 66B, and part of the light passes through the through holes 65*b* of the light shielding mask 65B to become incident on the liquid crystal shutter 6B. As described above, since the directivity of light is enhanced at the light diffusing layer 66B and the light shielding mask 65B, variation of the amount of the light in the primary scanning direction is lessened.

At the liquid crystal shutter 6B, the light is selectively allowed to pass through or blocked by the first through the third shutter portions 67*a*–67*c* under the control of the drive IC 64 based on the image data. For example, for irradiating red light, the second and the third shutter portions 67*b* and 67*c* are made light-blocking state, whereas selected ones of the first shutter portions 67*a* pass the light.

At that time, when a non-selected first shutter portion 67*a* through which light should not pass exists adjacent to the selected first shutter portion 67*a*, a potential difference is generated between the segment electrodes 60A and 60B constituting the shutter portions 67*a* or between the common electrodes 61Ra and 61Rb (61Ga, 61Gb, 61Ba, 61Bb). Such a potential difference is more likely to be generated as the distance between the electrodes (between adjacent shutter portions) decreases. When the potential difference is generated between the adjacent electrodes, the alignment of liquid crystal nearby is disturbed. As a result, the light component of green light or blue light, for example, may unintentionally pass through the liquid crystal shutter 6B.

In the liquid crystal shutter 6B, however, the first through the third shutter portions 67*a*–67*c* are respectively disposed in staggered relationship in two rows for keeping a relatively large distance between adjacent shutter portions. Therefore, the disturbance of liquid crystal around the non-selected shutter portion can be avoided, which prevents unintended light from passing through the liquid crystal shutter 6B for emission from the print head 3B.

As shown in FIG. 17, the light passing through the liquid crystal shutter 6B and emitted from the print head 3B reaches the reflector 33. The light is then regularly reflected by the reflector 33, thereby changing its traveling direction by 90 degrees before entering the rod lens array 31. At the rod lenses 313, the light traveling at an angle larger than the opening angle of the lenses cannot enter the rod lenses 313. Since the directivity of light is enhanced by the light diffusing layer 66B or the light shielding mask 65B, a large amount of light can enter the rod lens 31 so that the light emitted from the light source 57 can be efficiently utilized. Generally, when the width of the light source 57 is increased, the maximum emission angle of the light emitting from the light source 57 tends to increase so that the efficiency of light entrance to the rod lens 31 tends to decrease. However, by enhancing the directivity of light, a large amount of light can enter the rod lens 31 even when the width of the light source is increased. As a result, it is possible to avoid the influence of local degradation of the light source 57 and to make the emitting amount of light uniform in the primary scanning direction.

Figure 22:
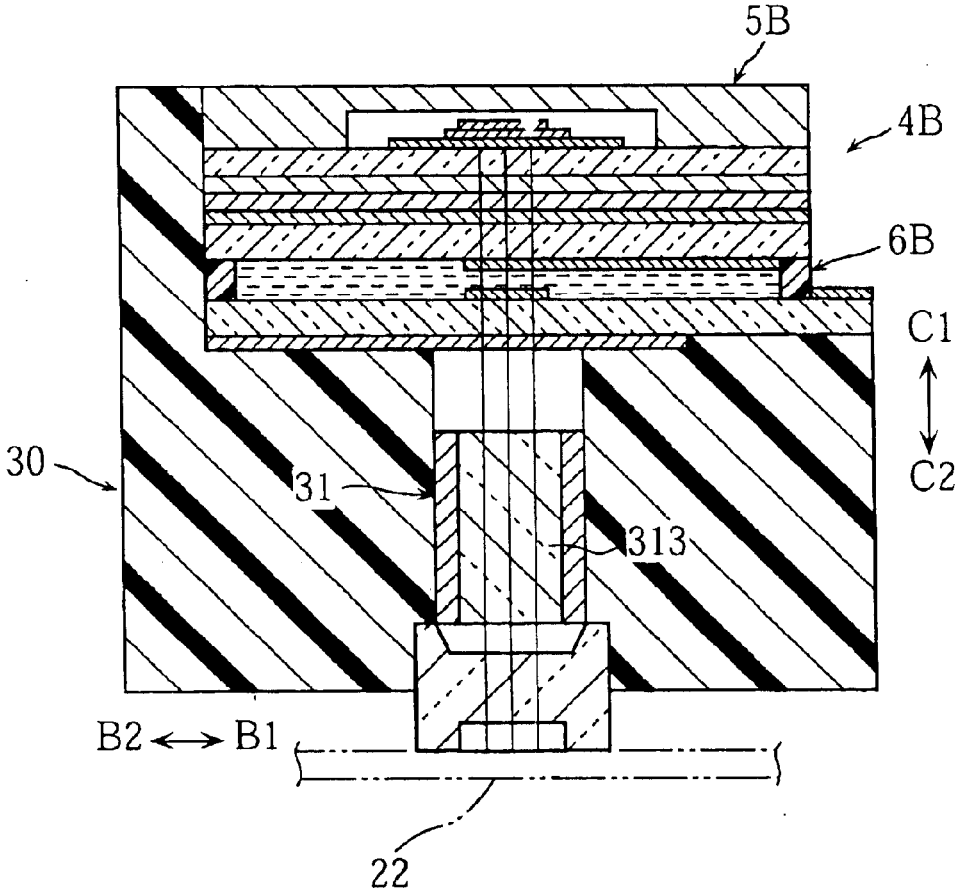
FIG. 22 is a sectional view illustrating another example of print head.

In the third embodiment of the present invention, the lens array was so arranged that the lens axes of the rod lenses extend in the secondary scanning direction. However, as shown in FIG. 22, the rod lenses 313 may be so arranged that the lens axes of the rod lenses 313 extend in the thickness direction C1, C2 of the frame 30.

The stack unit may have such a structure that will be described with reference to FIGS. 23-25 as a fourth embodiment or such a structure that will be described with reference to FIGS. 26-28 as a fifth embodiment. In these figures, the members or elements which are identical or similar to those of the above-described stack unit 4B are designated by the same reference signs, and the description thereof will be omitted.

Figure 23:
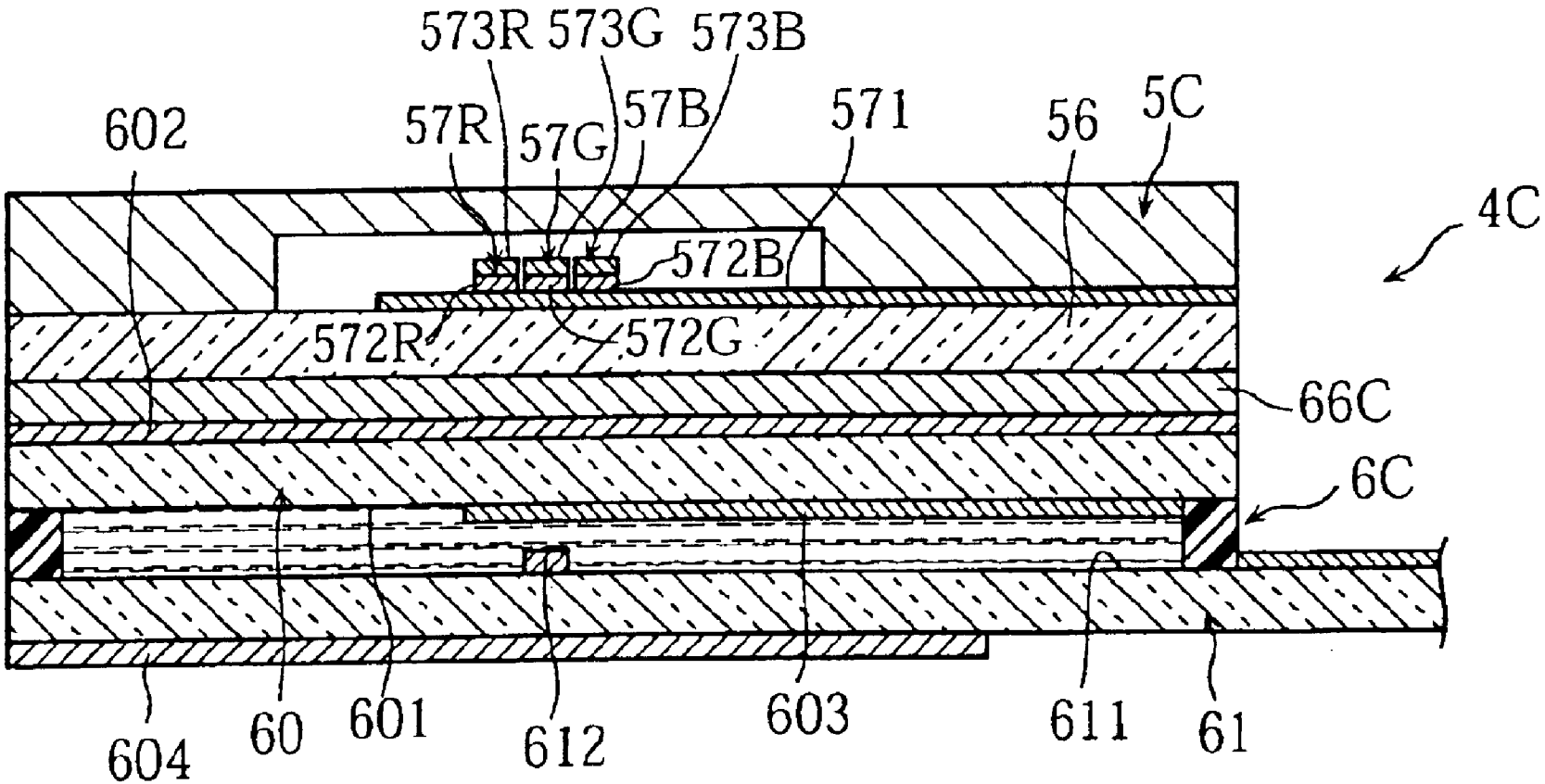
FIG. 23 is a sectional view illustrating a stack unit according to a fourth embodiment of the present invention.
Figure 24:
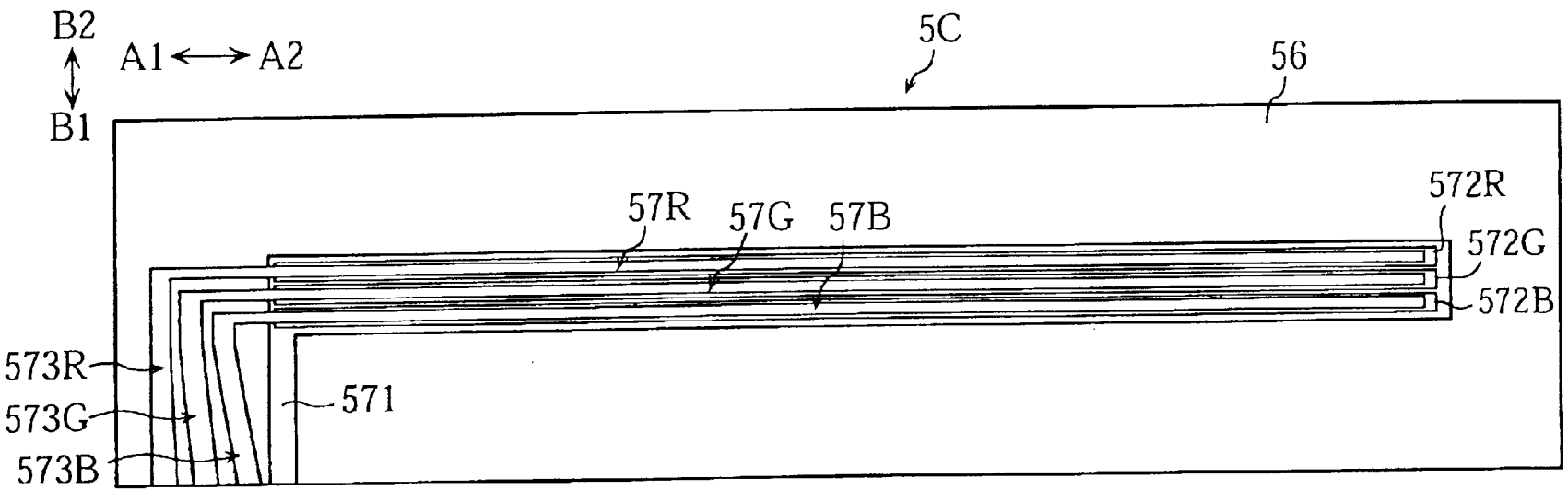
FIG. 24 is an enlarged plan view illustrating a principal portion of a light source device of the stack unit shown in FIG. 23.
Figure 25:
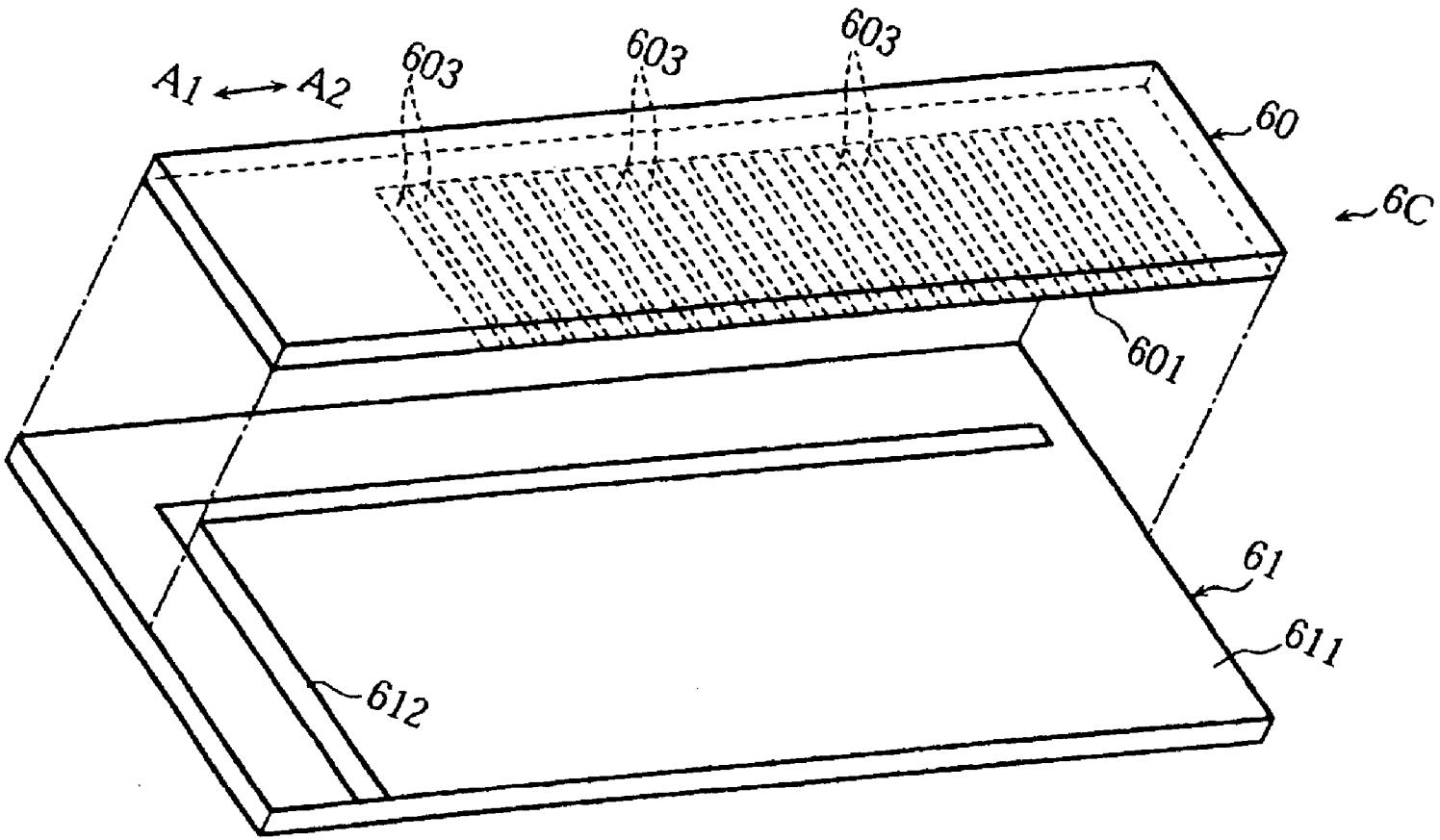
FIG. 25 is an exploded perspective view illustrating a liquid crystal shutter of the stack unit shown in FIG. 23.

The stack unit 4C according to a fourth embodiment shown in FIGS. 23-25 comprises a liquid crystal shutter 6C and an illuminator 5C stacked thereon via a light diffusing layer 66C. The provision of a light shielding mask 65B (See FIGS. 5 and 8) in the stack unit 4C is eliminated, because the illuminator 5C can individually emit red light, green light and blue light as will be described later and the liquid crystal shutter 6*c* comprises a single row of shutter portions. However, the liquid crystal shutter 6C may be provided with a light shielding mask formed with through-holes corresponding to the shutter portions.

As shown in FIGS. 23 and 24, the illuminator 5C includes a linear red light source 57R, a linear green light source 57G and a linear blue light source 57B which extend in the primary scanning direction A1, A2. The linear red light source 57R, the linear green light source 57G and the linear blue light source 57B are formed by stacking an anode 571, three organic layers 572R, 572G, 572B and three cathodes 573R, 573G, 573B on a transparent substrate 56 in the mentioned order. The anode 571 may be formed of e.g. ITO to be transparent. The cathodes 573R, 573G, 573B may be formed of e.g. aluminum to be highly reflective.

Each of the organic layers 572R, 572G, 572B includes a light emitting layer containing an organic luminous material. By selecting the kind of luminous material to be used for each layer, the organic layers can emit red light, green light and blue light, respectively. Therefore, the illuminator 5C can individually emit red, green or blue linear light by applying electric field to selected one of the organic layers 572R, 572G, 572B.

As shown in FIGS. 23 and 25, the liquid crystal shutter 6C includes a substrate 60 having a facing surface 601 formed with a plurality of segment electrodes 603, and a substrate 61 having a facing surface 611 formed with a common electrode 612. The common electrode 612 includes a portion extending in the primary scanning direction A1, A2 for crossing the plurality of segment electrodes 603. The crossed portions constitute shutter portions. Thus, a plurality of shutter portions are aligned in a row extending in the primary scanning direction A1, A2.

In the stack unit 4C, red linear light, green linear light and blue linear light are individually and successively emitted from the illuminator 5C so that irradiation is performed three times for forming an image for one line. At the liquid crystal shutter 6C, each shutter portion selectively passes or blocks each color of light based on the image data.

In the stack unit 4C, after the light emitted from the linear light sources 57R, 57G, 57B becomes incident on the liquid crystal shutter 6C, light passes through the liquid crystal shutter 6C before being emitted from the light emitting surface 323 (See FIG. 17) of the prism 32. Thus, the liquid crystal shutter 6C can define the state of light (amount, wavelength and the like) to be emitted from the light emitting surface 323. Therefore, even when the linear light source 57R, 57G or 57B includes a portion emitting a smaller amount of light, for example, and hence variation exists in the amount of light, the liquid crystal shutter 6C can eliminate such variation.

The positional relationship relative to the shutter portions differ among the three linear light sources 57R, 57G, 57B. Therefore, if the light diffusing layer 66C is not provided, the angle of incidence of light entering the shutter portions or the amount of light may differ among the three linear light sources 57R, 57C, 57B. However, since the light diffusing layer 66C is provided in this embodiment, light with high directivity is emitted from the light diffusing layer 66C. Therefore, light emitted from the three linear light sources 57R, 57G, 57G can enter the liquid crystal shutter 6C approximately at the same angle of incidence and by the same amount.

Figure 26:
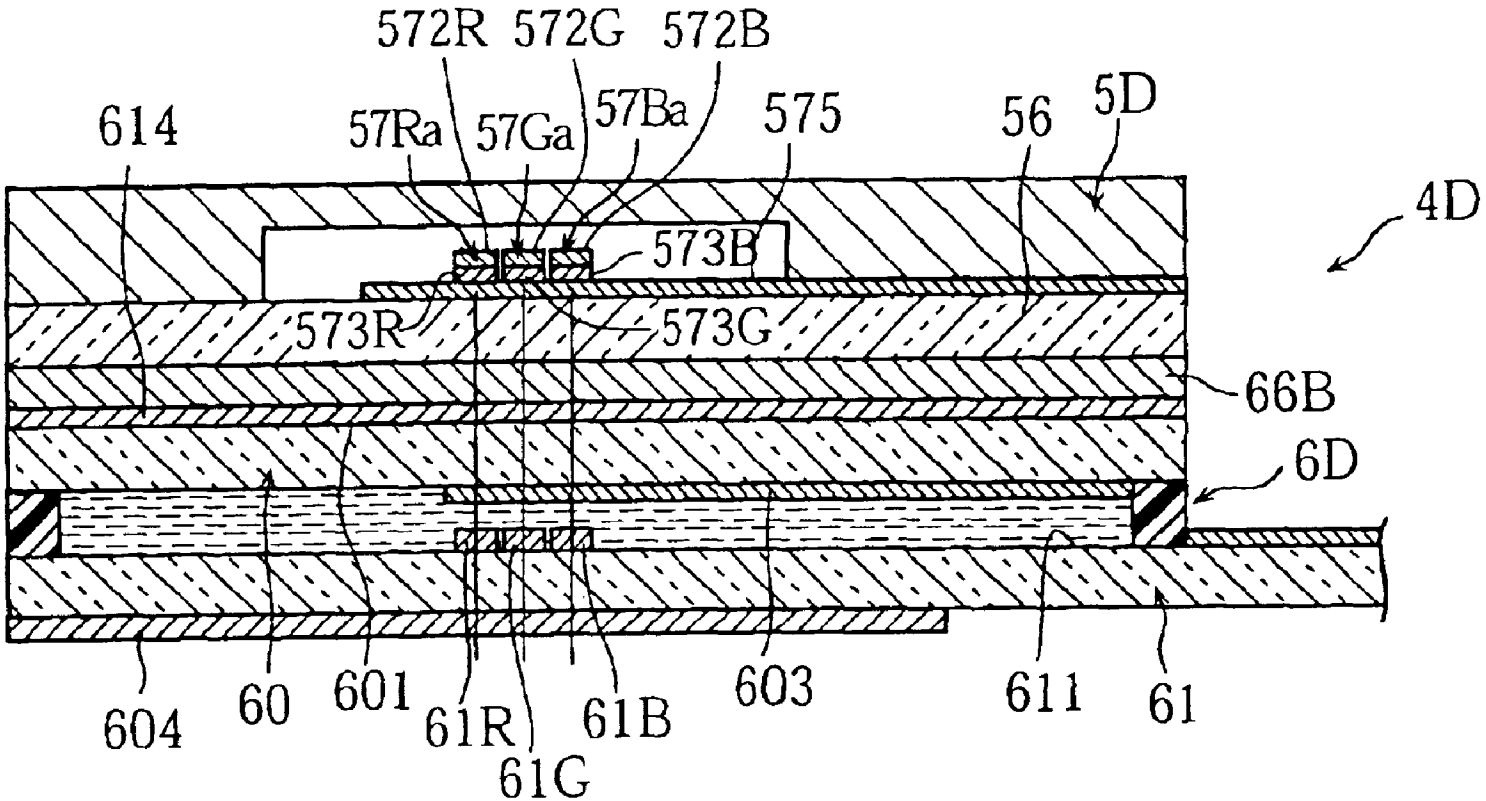
FIG. 26 is a sectional view illustrating a stack unit according to a fifth embodiment of the present invention.
Figure 27:
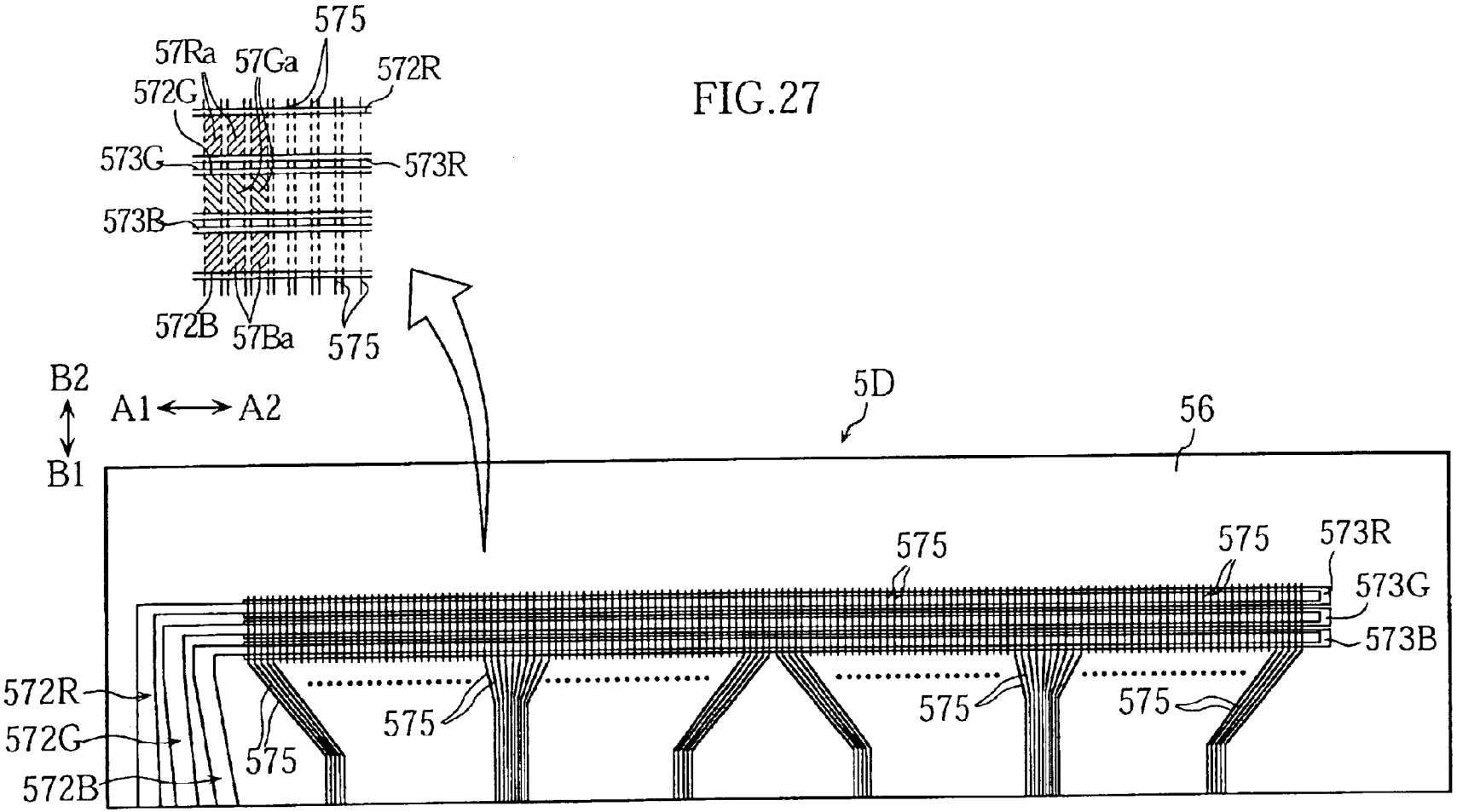
FIG. 27 is an enlarged plan view illustrating a principal portion of a light source device of the stack unit shown in FIG. 26.
Figure 28:
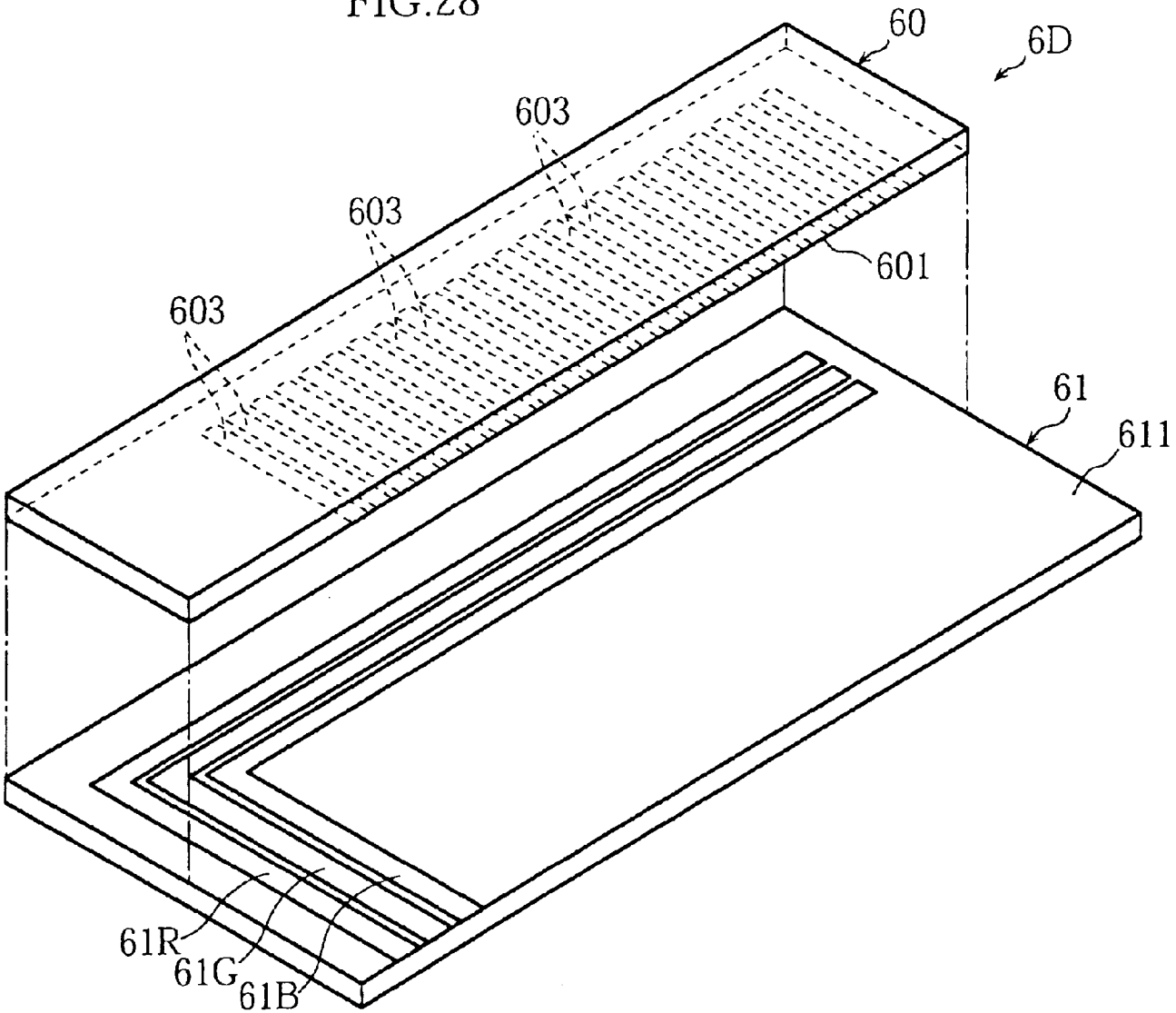
FIG. 28 is an exploded perspective view illustrating a liquid crystal shutter of the stack unit shown in FIG. 26.

The stack unit 4D according to a fifth embodiment shown in FIGS. 26-28 includes an illuminator 5D and a liquid crystal shutter 6D which differ in structure from those of the stack unit 4C shown in FIGS. 23-25.

As shown in FIGS. 26 and 27, the illuminator 5D includes a plurality of red point light sources 57Ra, a plurality of green point light sources 57Ga and a plurality of blue point light sources 57Ba aligned in the primary scanning direction A1, A2 on a transparent substrate 56. That is, a linear red light source 57R, a linear green light source 57G and a linear blue light source 57B (See FIG. 23) each is provided by a row of plural point light sources 57Ra, 57Ga or 57Ba of a same color. In other words, each linear light source is constituted by a group of point light sources. In the illuminator 5D, each of the point light sources 57Ra, 57Ga, 57Ba can be turned on and off individually. In actual driving, however, turning on and off is performed with respect to each row of point light sources of a same color for emitting red linear light, green linear light or blue linear light.

The point light sources 57Ra, 57Ga, 57Ba may be provided by forming an element corresponding to the anode 571 (See FIG. 24) of the illuminator 5D as a plurality of individual electrodes 575.

Each of the point light sources 57Ra, 57Ga, 57Ba includes an organic layer 572R, 572G, 572B, each preferably containing an appropriate kind of luminous material for emitting red light, green light or blue light. Alternatively, however, white light may be emitted from the light emitting layers and color filters may be used for emitting red light, green light or blue light from the point light sources 57Ra, 57Ga, 57Ba.

As shown in FIGS. 26 and 28, the liquid crystal shutter 6D includes a substrate 60 having a facing surface 601 formed with a plurality of segment electrodes 603, and a substrate 61 having a facing surface 611 formed with three common electrodes 61R, 61G, 61B. Each of the common electrodes 61R, 61G, 61B includes a portion extending in the primary scanning direction A1, A2 for crossing the plurality of segment electrodes 603. The crossed portions constitute a first through a third shutter portions. Thus, there are provided three rows of shutter portions extending in the primary scanning direction A1, A2. Each row of the shutter portions is provided directly below the row of point light sources 57Ra, 57Ga, 57Ba of the same color.

In the stack unit 4D, red linear light, green linear light and blue linear light are individually and successively emitted from the illuminator SD so that irradiation is performed three times for forming an image for one line. At the liquid crystal shutter 6D, each shutter portion of the row corresponding to the row of point light sources 57Ra, 57Ga, 57Ba from which light is being emitted selectively passes or blocks the light based on the image data. At that time, the shutter portions of the remaining two rows keep the light blocking state.

The liquid crystal shutter need not necessarily constitute a stack unit together with the light source device but may be provided separately from the light source device. Further, in forming a monochromatic image, it is not necessary to provide a color filter or the like for providing each shutter portion with wavelength selectivity. Each shutter portion may be designed for active driving. Whether or not a lens array is used for the print head is selectable, and a lens array other than a rod lens array may be used.

Figures 29A, 29B, 29C:
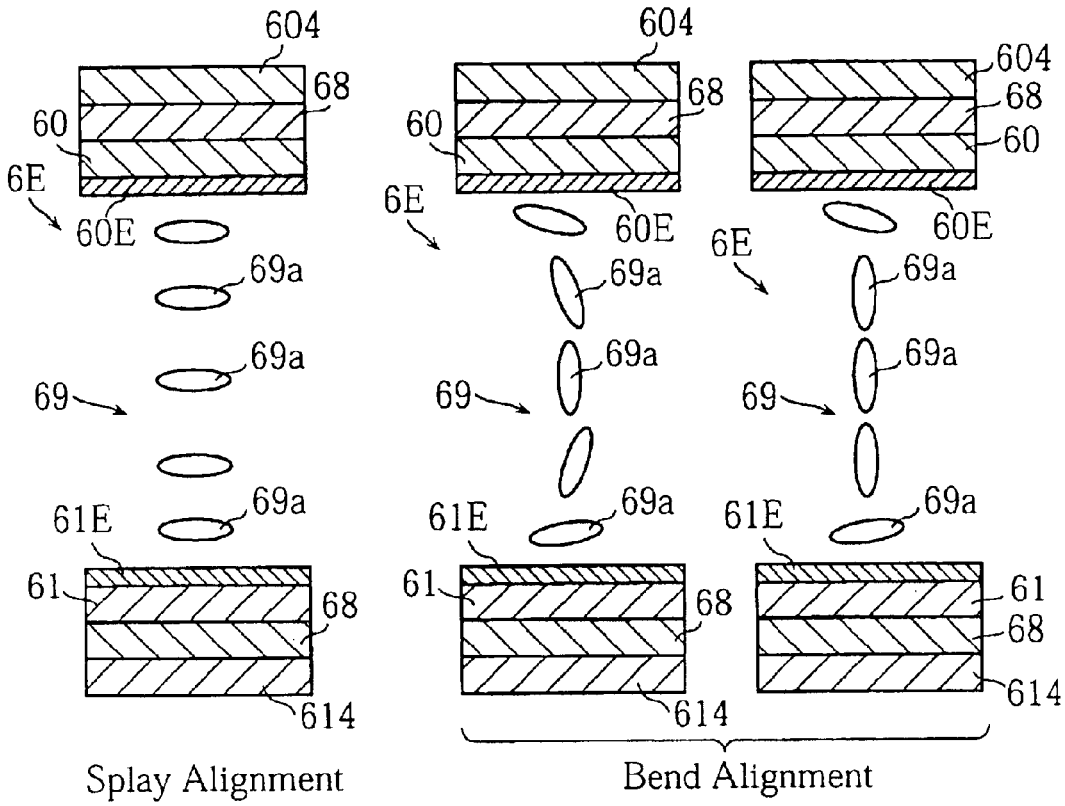
FIGS. 29A-29C are sectional views of principal portions for describing another example of liquid crystal shutter.

As the liquid crystal shutter, use may be made of one utilizing the OCB (Optically Compensated Birefringence) mode. The OCB mode may be realized by the structure as shown in FIG. 29A, for example. In the liquid crystal shutter 6E shown in the figure, liquid crystal 69 is retained between a pair of transparent substrates 60 and 61 so as to realize splay alignment (the state in which liquid crystal molecules 69*a* are aligned with their axes extending in parallel to the transparent substrates 60, 61) when no voltage is applied. The liquid crystal shutter 6E includes phase compensation films (biaxial films) 68 disposed between transparent substrates 60, 61 and polarizers 604, 614. As shown in FIG. 29B, when a voltage no less than a predetermined value is applied to the liquid crystal 69 of the liquid crystal shutter 6E, liquid crystal molecules 29*a* at the intermediate region in the thickness direction change to bend alignment in which the molecules are oriented generally vertically. The state shown in the figure is a so-called steady state. In the steady state, the liquid crystal molecules 29*a* at the intermediate region have a large pretilt angle. Therefore, the bend alignment is highly responsive to voltage variations, and for example, changes to the state shown in FIG. 29C in several msec when high voltage is applied.

In the OCB mode, transition of the liquid crystal 69 from the splay state to the bend state need be performed during the initial driving of the liquid crystal shutter 6E. However, since the transition takes a relatively long time, the transition time may become a rate-limiting factor which increase the time required for printing. The transition time may be shortened by increasing a voltage applied to the liquid crystal 69 in the initial driving. However, in a small apparatus, the provision of a driving circuit for the initial driving is not preferable in view of the size reduction and cost performance of the apparatus.

Figure 30A:
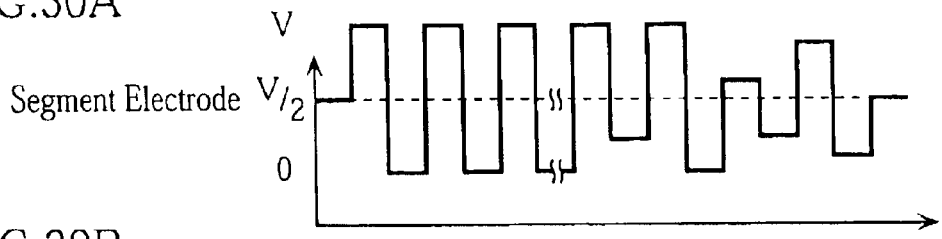
FIGS. 30A-30C illustrate voltage application waveform.
Figure 30B:
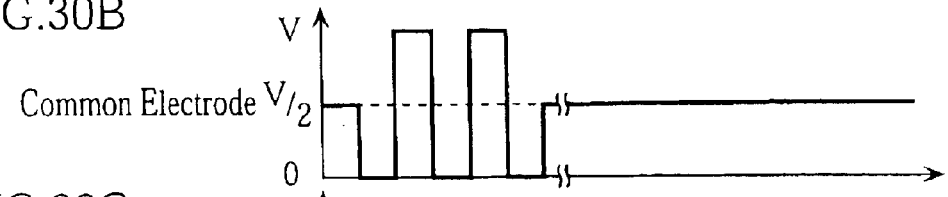
Figure 30C:
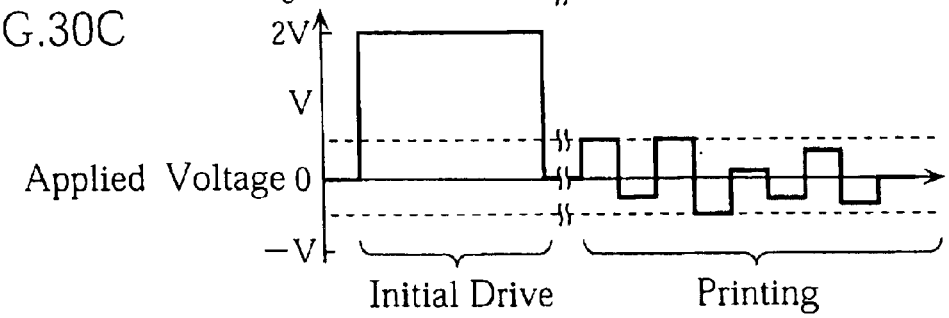

However, when a driving method described below with reference to FIGS. 30A and 30B is utilized, it is possible to perform high-speed printing without providing a circuit for the initial driving. As shown in FIGS. 30A and 30B, during the initial driving (transition period), voltage is applied to the segment electrodes 60E and the common electrodes 61E under the control by a non-illustrated drive IC for example to provide AC waveforms which are phase-shifted by 180 degrees from each other. As a result, as shown in FIG. 30C, sufficient voltage for performing the transition of alignment of the liquid crystal 69 can be applied to the liquid crystal 69. Since such voltage application can be performed using an existing circuit for driving the liquid crystal 69 in printing, the size of the apparatus does not increase. Further, since high voltage is applied during the initial driving, it is possible to shorten the time required for transition from the splay alignment to the bend alignment.

What is claimed is:

1. A print head comprising:

an illuminator for emitting light in a line extending in a primary scanning direction;

a liquid crystal shutter for selecting whether or not light traveling from the illuminator is allowed to pass;

a light emitting portion for emitting light traveling from the liquid crystal shutter toward a photosensitive recording medium;

a frame having a predetermined thickness and elongated in the primary scanning direction for supporting the illuminator and the liquid crystal shutter, the illuminator being stacked on the liquid crystal shutter to provide a stack unit; and a lens array including a plurality of lenses having lens axes, the lens array being held between the stack unit and the frame with the lenses aligned in the primary scanning direction and with the lens axes extending in a secondary scanning direction perpendicular to the primary scanning direction;

wherein light is emitted from the stack unit for traveling thicknesswise of the frame, the light entering the lens array after its traveling direction is changed by 90 degrees or substantially 90 degrees, the light changing its traveling direction by 90 degrees or substantially 90 degrees after the light is emitted from the lens array.

2. The print head according to claim 1, wherein the liquid crystal shutter includes a plurality of individual shutter portions aligned in the primary scanning direction;

each of the shutter portions being capable of individually selecting whether or not the light traveling front the illuminator is allowed to pass.

3. The print head according to claim 2, wherein the illuminator emits light including red light, green light and blue light;

the plurality of shutter portions including a plurality of first shutter portions aligned in a row extending in the primary scanning direction for selectively passing red light, a plurality of second shutter portions aligned in a row extending in the primary scanning direction for selectively passing green light, and a plurality of third shutter portions aligned in a row extending in the primary scanning direction for selectively passing blue light.

4. The print head according to claim 3, wherein the first shutter portions, the second shutter portions and the third shutter portions are respectively arranged in a plurality of rows, the shutter portions in each row are disposed in staggered relationship with the shutter portions in an adjacent row.

5. The print head according to claim 1, wherein the liquid crystal shutter includes a plurality of first electrodes arranged adjacent to each other, a plurality of second electrodes arranged adjacent to each other and extending transversely to the first electrodes, and a liquid crystal layer provided between the first electrodes and the second electrodes.

6. The print head according to claim 5, wherein the plurality of first electrodes includes a pair of electrodes for red light, a pair of electrodes for green light and a pair of electrodes for blue light;

each of the second electrodes includes a plurality of main overlapping portions which overlap one of the paired electrodes for red light, one of the paired electrodes for green light or one of the paired electrodes for blue light, and a connecting portion connecting adjacent ones of the main overlapping portions.

7. The print head according to claim 6, wherein the connecting portion is smaller in width than the main overlapping portions.

8. The print head according to claim 1, wherein the liquid crystal shutter is adapted for driving in OCB mode.

9. The print head according to claim 8, wherein the liquid crystal shutter includes a first transparent substrate, a second transparent substrate arranged in facing relationship to the first transparent substrate, and liquid crystal retained between the first and the second transparent substrates so as to keep splay alignment when no voltage is applied.

10. The print head according to claim 9, further comprising control means for driving the liquid crystal shutter;

the control means operating for applying a voltage to the liquid crystal which is higher than a minimum transition voltage required for causing transition of the liquid crystal from splay alignment to bend alignment.

11. The print head according to claim 10, wherein the liquid crystal shutter includes at least one first electrode formed on the first transparent substrate and at least one second electrode formed on the second transparent substrate, said at least one first electrode and said at least one second electrode being utilized for applying voltage to the liquid crystal; and wherein the control means applies, in causing transition of the liquid crystal from splay alignment to bend alignment, an AC voltage to the first electrode while applying an AC voltage to the second electrode to provide an AC waveform having a same cycle as and 180-degrees phase-shifted from that of the AC voltage of the first electrode, a voltage applied across the liquid crystal being higher than the minimum transition voltage.

12. The print head according to claim 1, wherein the liquid crystal shutter includes a first transparent substrata, a second transparent substrate arranged in facing relationship to the first transparent substrate, and liquid crystal retained between the first and the second transparent substrates, the liquid crystal being twisted by addition of cyanide as a chiral dopant.

13. The print head according to claim 12, wherein rho cyanide is added in an amount of 0.1–4.0 parts by weight relative to 100 parts by weight of liquid crystal.

14. The print head according to claim 1, wherein the liquid crystal shutter comprises a pair of transparent substrates and ferroelectric liquid crystal or antiferroelectric liquid crystal retained therebetween.

15. The print head according to claim 1, wherein the illuminator includes a red light source for emitting red light in a line, a green light source for emitting green light in a line, and a blue light source for emitting blue light in a line.

16. The print head according to claim 1, wherein the illuminator is provided with an organic light source including a light emitting layer containing an organic material, the organic material emitting light by electroluminescence when electric field is applied.

17. The print head according to claim 16, wherein the organic light source is covered with a sealing portion formed of an inorganic insulating material.

18. The print head according to claim 1, wherein the illuminator includes a light source device including one or a plurality of point light sources, and a light guide for guiding the light emitted from said one or the plurality of point light sources for emission of light in a line extending in the primary scanning direction.

19. The print head according to claim 18, wherein the light guide has a bar-like configuration extending in the primary scanning direction, the light guide including a light incident surface for introducing light therein, and a light reflecting surface, and a light emitting surface spaced thicknesswise from the light reflecting surface.

20. The print head according to claim 19, wherein:

the light incident surface is provided at an end portion of the light guide;

the light reflecting surface including a plurality of inclined surfaces inclined toward the light incident surface for making light traveling from the light incident surface emit from the light emitting surface.

21. The print head according to claim 20, wherein:

the plurality of inclined surfaces are provided by forming a plurality of recesses at an obverse surface of the light guide;

the plurality of recesses having progressively increasing depths away from the light incident surface.

22. The print head according to claim 21, wherein the plurality of inclined surfaces are equal or substantially equal to each other in angle of inclination.

23. The print head according to claim 21, wherein the light guide includes a plurality of additional inclined surfaces for guiding light reflected at an end surface located opposite to said end portion toward the light emitting surface.

24. The print head according to claim 19, wherein the plurality of point light sources include a red point light source for emitting red light, a green point light source for emitting green light and a blue point light source for emitting blue light;

the light source device including a substrate on which the red point light source, the green point light source and the blue point light source are mounted, and a plurality of wirings formed on the substrate.

25. The print head according to claim 24, wherein the red point light source, the green point light source and the blue point light source are aligned in a row extending in the secondary scanning direction, the substrate and the light incident surface facing each other while standing upright with respect to the light emitting surface.

26. The print head according to claim 25, wherein:

each of the red point light source, the green point light source and the blue point light source includes a first electrode and a second electrode;

the plurality of wirings being Conned on a surface of the substrate on which the point light sources are mounted, the wirings including a first wiring electrically connected to the first electrode via a conductor wire and a second wiring electrically connected to the second electrode;

the conductor wire extending obliquely to a direction perpendicular to the row of the light sources.

27. The print head according to claim 24, wherein each of the red point light source, the green point light source and the blue point light source is capable of being driven individually.

28. The print head according to claim 18, wherein the light guide is covered with a light shield for absorbing light emitted from the light guide.

29. The print head according to claim 28, wherein the light shield is formed with an opening extending in the primary scanning direction for emitting light therethrough, the light shield including a first light shielding portion covering the light emitting surface of the light guide and a second light shielding portion covering portions of the light guide other than the light emitting surface.

30. The print head according to claim 18, wherein the light guide is covered with a reflector for returning light exiting the light guide into the light guide.

31. The print heed according to claim 30, wherein the light guide is covered with a light shield for absorbing light exiting the light guide and passing the reflector.

32. The print head according to claim 18, wherein said one point light source emits light including red light, green light and blue light.

33. The print head according to claim 32, wherein:

the liquid crystal shutter includes a plurality of individual shutter portions;

the plurality of shutter portions including a plurality of first shutter portions aligned in a row extending in the primary scanning direction for selectively passing red light, a plurality of second shutter portions aligned in a row extending in the primary scanning direction for selectively passing green light, and a plurality of third shutter portions aligned in a row extending in the primary scanning direction for selectively passing blue light.

34. The print head according to claim 18, wherein said one or plurality of point light sources comprise LED bare chips.

35. The print bead according to claim 1, wherein the liquid crystal shutter includes a light entrance side covered with a light shielding layer formed with a through-hole for limiting light entering the liquid crystal shutter.

36. The print head according to claim 1, wherein a light diffusing portion is provided between the illuminator and the liquid crystal shutter.

37. The print head according to claim 1, wherein the light emitting portion includes a projection for coming into engagement with the photosensitive recording medium and a recess for emitting light in a line.

38. The print head according to claim 1, wherein the stack unit is supported in close contact with the frame at a position deviated thicknesswise from a center of the frame.

39. The print head according to claim 1, further comprising a prism for changing the traveling direction of the light emitted from the lens array, the light emitting portion being provided at the prism.

40. The print head according to claim 39, wherein the prism includes a light incident surface for entrance of light traveling from the lens array, the light incident surface being formed with a recess extending in the primary scanning direction.

41. A print head comprising:

an illuminator for emitting light in a line extending in a primary scanning direction;

a liquid crystal shutter for selecting whether or not light traveling from the illuminator is allowed to pass;

a light emitting portion for emitting light traveling from the liquid crystal shutter toward a photosensitive recording medium;

a frame having a predetermined thickness and elongated in the primary scanning direction for supporting the illuminator and the liquid crystal shutter; and a bar-like member held by the frame and having a longitudinal axis extending in the primary scanning direction, wherein the bar-like member includes a projection for coming into engagement with the photosensitive recording medium and a recess for emitting light in a line.

42. The print head according to claim 41, further comprising a lens array including a plurality of lenses having lens axes, wherein the lens array is held by the frame with the lenses aligned in the primary scanning direction and with the lens axes extending thicknesswise of the frame.

* * * * *